US007920800B2

(12) United States Patent
Nakazato et al.

(10) Patent No.: US 7,920,800 B2
(45) Date of Patent: Apr. 5, 2011

(54) IMAGE FORMING APPARATUS AND FAILURE DETECTION METHOD THEREFOR

(75) Inventors: Yasushi Nakazato, Setagaya-ku (JP); Kohji Ue, Ebina (JP); Osamu Satoh, Sagamihara (JP); Masahide Yamashita, Ohta-ku (JP); Jun Yamane, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 521 days.

(21) Appl. No.: 12/031,453

(22) Filed: Feb. 14, 2008

(65) Prior Publication Data

US 2008/0199193 A1 Aug. 21, 2008

(30) Foreign Application Priority Data

Feb. 15, 2007 (JP) ..... 2007-035068

(51) Int. Cl.
*G03G 15/00* (2006.01)

(52) U.S. Cl. ..... 399/49; 399/9

(58) Field of Classification Search ..... 399/9, 49
See application file for complete search history.

(56) References Cited

U.S. PATENT DOCUMENTS

| | | | |
|---|---|---|---|
| 6,285,839 | B1 | 9/2001 | Tanaka et al. |
| 7,444,090 | B2 * | 10/2008 | Nishida et al. |
| 2008/0075476 | A1 * | 3/2008 | Nakazato et al. |

FOREIGN PATENT DOCUMENTS

| | | |
|---|---|---|
| JP | 5-100517 | 4/1993 |
| JP | 5-281809 | 10/1993 |
| JP | 5-323740 | 12/1993 |
| JP | 7-36323 | 2/1995 |
| JP | 7-104616 | 4/1995 |
| JP | 7-104619 | 4/1995 |
| JP | 8-137344 | 5/1996 |
| JP | 11-296027 | 10/1999 |
| JP | 2000-89623 | 3/2000 |
| JP | 2000-267508 | 9/2000 |
| JP | 2001-356655 | 12/2001 |
| JP | 2004-219617 | 8/2004 |
| JP | 3831143 | 7/2006 |

OTHER PUBLICATIONS

Machine translation of JP-2000-267508.*

U.S. Appl. No. 12/184,734, filed Aug. 1, 2008, Nakazato, et al.

* cited by examiner

*Primary Examiner* — David M Gray
*Assistant Examiner* — G. M. Hyder
(74) *Attorney, Agent, or Firm* — Oblon, Spivak, McClelland, Maier & Neustadt, L.L.P.

(57) ABSTRACT

An image forming apparatus includes toner image forming devices for forming toner images of a plurality of mutually different colors, a toner image carrying member for carrying thereon the toner images of the plurality of colors to be transferred onto a recording medium at one time, an adhesion amount detection device for detecting a toner adhesion amount of each of the toner images, and a failure determination device for determining the presence or absence of a sign of failure in the toner image forming devices. The failure determination device determines the presence or absence of the sign of failure in one of the toner image forming devices on the basis of information based on adhesion amount detection results obtained through detection by the adhesion amount detection device of toner adhesion amounts of toner images formed on the toner image carrying member by the other toner image forming devices.

15 Claims, 15 Drawing Sheets

IMAGE FORMING APPARATUS AND FAILURE DETECTION METHOD THEREFOR

CROSS-REFERENCE TO RELATED APPLLICATION

This application claims priority to Japanese Patent Application No. 2007-035068 filed on Feb. 15, 2007, the entire contents of which are hereby incorporated by reference herein.

BACKGROUND

1. Field

The present invention relates to an image forming apparatus such as a copier, a printer, and a facsimile machine, and a failure detection method of detecting a failure in such an image forming apparatus.

2. Background Art

As a background color image forming apparatus, a tandem-type image forming apparatus for forming a color image is known which includes a plurality of toner image forming devices disposed along an intermediate transfer belt which constitutes an image carrying member for carrying thereon toner images of a plurality of colors. Each of the toner image forming devices includes a photoconductor, which constitutes an image carrying member for carrying thereon a toner image of a single color, and a charging device, a development device, a cleaning device, and so forth, which surround the photoconductor.

In the tandem-type image forming apparatus, the toner image forming device gradually deteriorates in function and lapses into an abnormal state due to such factors as frictional wear accompanying normal operation, external infiltration of harmful material such as paper powder, increase in adhesion of toner and loss of an external additive due to excessive mixing of the toner caused by an unexpected operation and so forth, contamination and degradation of the cleaning device or the charging device, and random failure of the cleaning device or the charging device.

In the abnormal state of the toner image forming device, image quality is degraded. Specifically, an undesirable abnormal image having a longitudinal streak extending along the rotational direction of the photoconductor, a blurred image, an abnormal image having a lateral streak extending perpendicular to the rotational direction, a blotted image having spots, a whited-out image, and so forth are generated. Normally, however, the toner image forming device continues to be operated, with such controls as image density control and color shift control performed to change an image forming condition and suppress the above-described deterioration of the image quality. Then, when such controls as the image density control and the color shift control are no longer capable of suppressing the deterioration of the image quality and an abnormal image is formed on a sheet, a user notices the abnormality of the toner image forming device, and performs a repair operation such as replacement of the toner image forming device.

As described above, in the background image forming apparatus, the repair is requested when the abnormal image is formed on the sheet. A normal image forming operation cannot be performed until the repair is completed. Thus, the image forming function is suspended. As a result, a substantial loss of time is caused to a user of the apparatus.

A variety of image forming apparatuses have been known that predict or determine a failure of the toner image forming device. For example, according to one background technique, an image forming apparatus detects the electric potential of an electrostatic latent image formed on the photoconductor of the toner image forming device by using a surface electrometer, and determines the replacement timing of the toner image forming device on the basis of the result of the detection.

According to another background technique, an image forming apparatus forms a linear toner image in an area on the photoconductor excluding a sheet-feeding area, collects the toner of the toner image, and determines the replacement timing of the toner image forming device on the basis of the amount of collected toner.

According to still another background technique, an image forming apparatus predicts the life of the toner image forming device on the basis of the number of times the toner image forming device is used. Further, according to still yet another background technique, an image forming apparatus outputs a signal prompting the replacement of the toner image forming device when any one of the layer thickness of the photoconductor, the remaining toner amount, and a gap between the photoconductor and a development roller falls below certain predetermined values.

SUMMARY

This patent specification describes an image forming apparatus including a plurality of toner image forming devices, a toner image carrying member, an adhesion amount detection device, and a failure determination device. The plurality of toner image forming devices form toner images of a plurality of mutually different colors. The toner image carrying member carries on a surface thereof the toner images of the plurality of colors to be transferred onto a recording medium at one time. The adhesion amount detection device detects a toner adhesion amount of each of the toner images of the plurality of colors formed and carried on the surface of the toner image carrying member. The failure determination device determines the presence or absence of a sign of failure in the toner image forming devices. The failure determination device determines the presence or absence of the sign of failure in one of the toner image forming devices on the basis of information based on adhesion amount detection results obtained through detection by the adhesion amount detection device of toner adhesion amounts of toner images formed on the surface of the toner image carrying member by the other toner image forming devices.

This patent specification further describes an image forming apparatus including toner image forming means, toner image carrying means, adhesion amount detection means, and failure determination means. The toner image forming means forms toner images of a plurality of mutually different colors. The toner image carrying means carries on a surface thereof the toner images of the plurality of colors to be transferred onto a recording medium at one time. The adhesion amount detection means detects a toner adhesion amount of each of the toner images of the plurality of colors formed and carried on the surface of the toner image carrying means. The failure determination means determines the presence or absence of a sign of failure in the toner image forming means. The failure determination means determines the presence or absence of the sign of failure in a part of the toner image forming means on the basis of information based on adhesion amount detection results obtained through detection by the adhesion amount detection means of toner adhesion amounts of toner images formed on the surface of the toner image carrying means by the other parts of the toner image forming means.

This patent specification further describes a failure detection method of detecting a failure in an image forming apparatus, including: causing a plurality of toner image forming devices to form, on a surface of a toner image carrying member, toner images of a plurality of mutually different colors to be transferred onto a recording medium at one time; detecting a toner adhesion amount of each of the toner images of the plurality of colors formed and carried on the surface of the toner image carrying member; and determining the presence or absence of a sign of failure in the toner image forming devices. The failure determination step determines the presence or absence of the sign of failure in one of the toner image forming devices on the basis of information based on adhesion amount detection results obtained through detection by the adhesion amount detection step of detecting toner adhesion amounts of toner images formed on the surface of the toner image carrying member by the other toner image forming devices.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
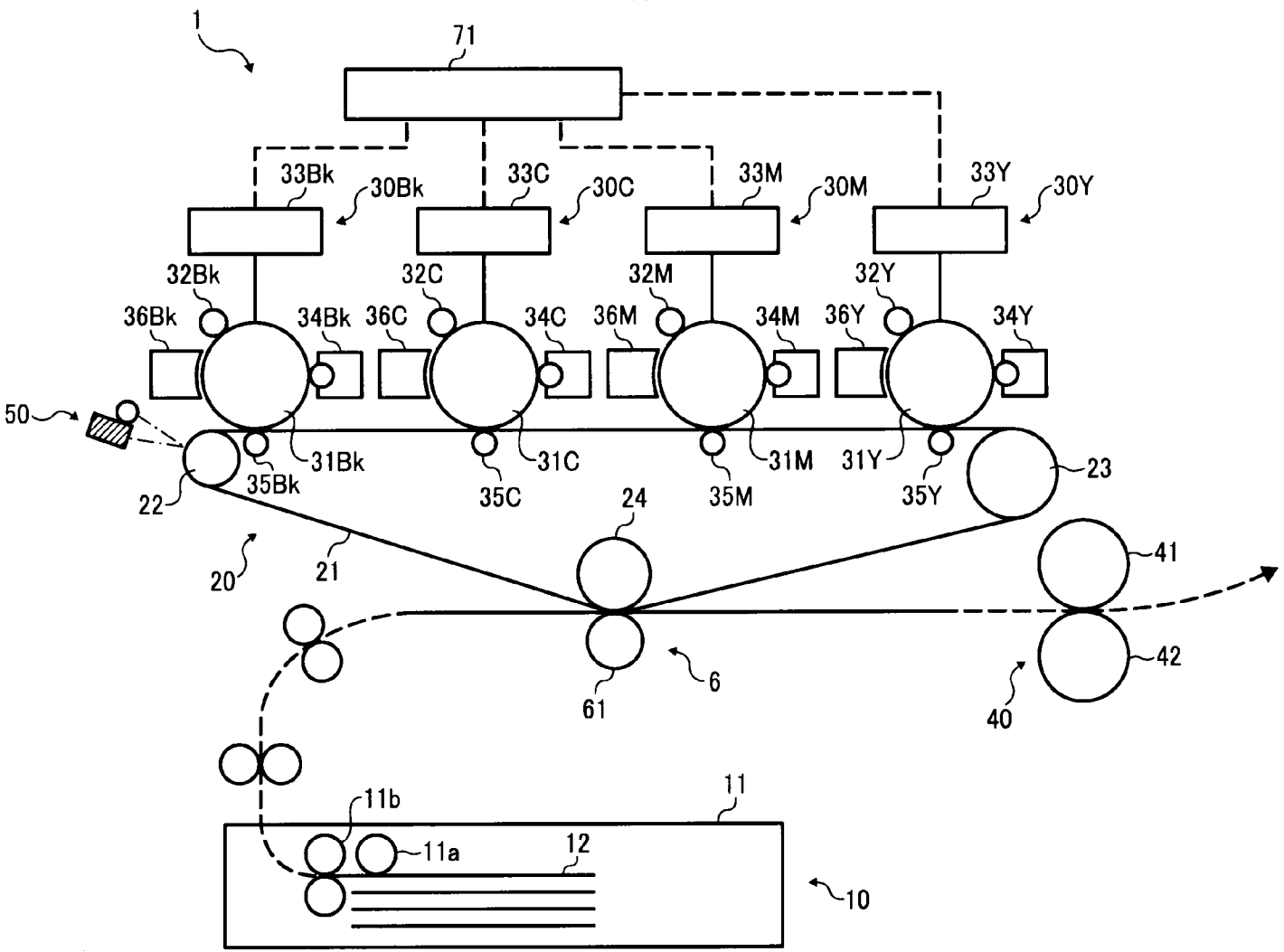
FIG. 1 is a schematic configuration diagram illustrating an example of an image forming apparatus according to an embodiment of the present invention.

In describing the embodiments illustrated in the drawings, specific terminology is employed for the purpose of clarity. However, the disclosure of this patent specification is not intended to be limited to the specific terminology so used, and it is to be understood that substitutions for each specific element can include any technical equivalents that operate in a similar manner.

Figure 2:
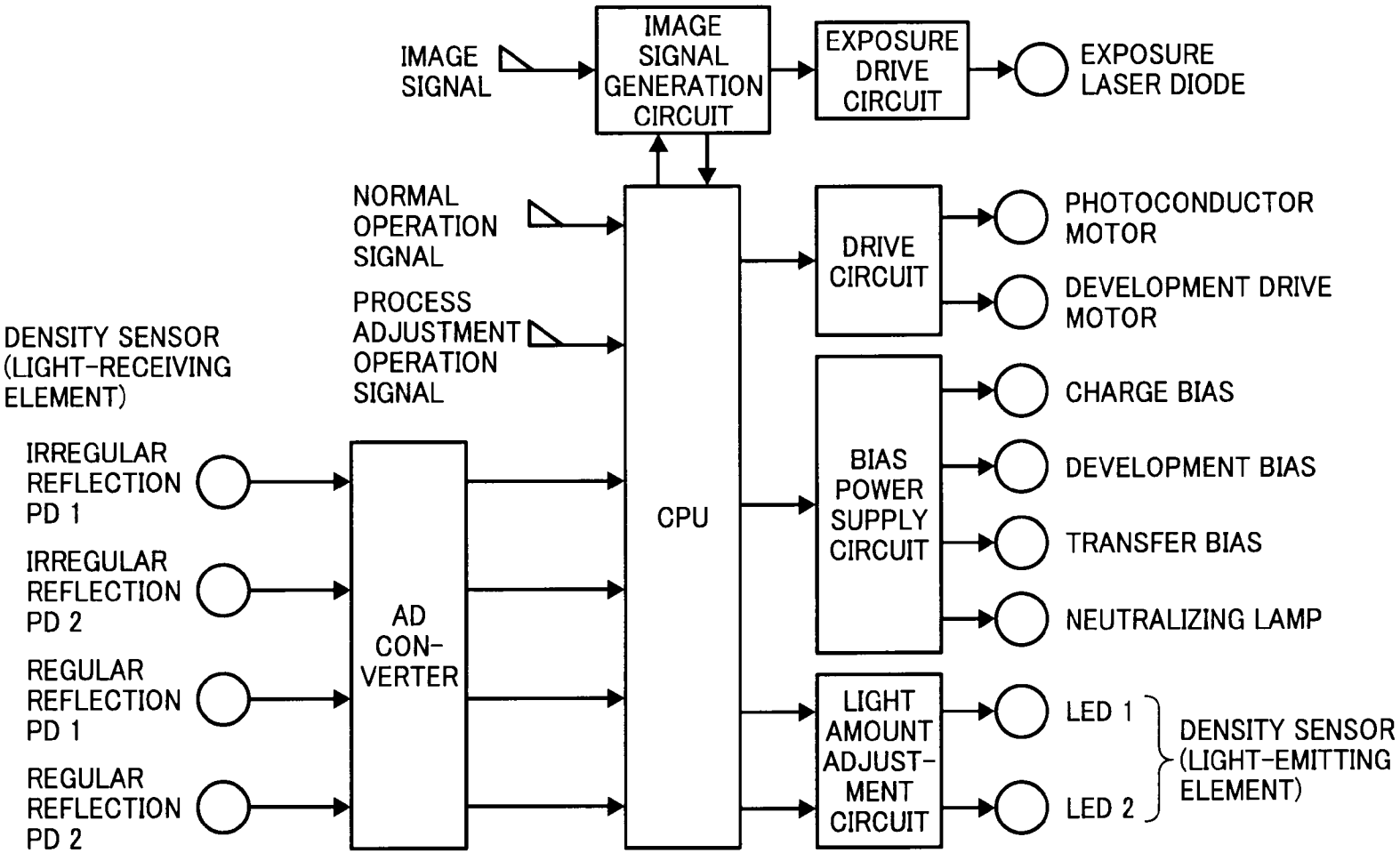
FIG. 2 is a block diagram illustrating essential parts of a system controller of the image forming apparatus.

Referring now to the drawings, wherein like reference numerals designate identical or corresponding parts throughout the several views, particularly to FIG. 1, description will be made of an embodiment of the present invention. FIG. 1 is a schematic configuration diagram illustrating an example of an image forming apparatus applied with the present invention. FIG. 2 is a block diagram illustrating essential parts of a system controller 71 of the image forming apparatus.

In FIG. 1, a color image forming apparatus 1 includes, in a body case thereof, a sheet-feeding unit 10, a transfer unit 20 including an intermediate transfer belt 21, and image forming units 30Y, 30M, 30C, and 30Bk disposed along the intermediate transfer belt 21 and constituting toner image forming devices for forming toner images of respective colors yellow (Y), magenta (M), cyan (C), and black (Bk). The color image forming apparatus 1 further includes, for example, a fixing unit 40 and an adhesion amount detection unit 50 for detecting a toner adhesion amount of a toner image formed on the intermediate transfer belt 21. In addition to the above components, the color image forming apparatus 1 includes, for example, the system controller 71 for controlling the color image forming apparatus 1, a control unit (not illustrated) for controlling the respective parts of the color image forming apparatus 1, and a drive mechanism unit (not illustrated) for transmitting power from a drive source to motors and respective parts driven by the motors.

The image forming units 30Y, 30M, 30C, and 30Bk for the respective colors will now be described. The following description is of the image forming unit 30Bk for the Bk color, which is similar in configuration to the other image forming units 30Y, 30M, and 30C for the colors Y, M, and C. In the image forming unit 30Bk, a charging unit 32Bk, an exposure unit 33Bk, a development unit 34Bk, a first transfer unit 35Bk, and a cleaning unit 36Bk, for example, are disposed around a photoconductor 31Bk.

In an image forming operation, when a normal operation signal is issued by an upper control device of the color image forming apparatus 1, the photoconductor 31Bk is driven to rotate by a drive motor (not illustrated) under the control of the system controller 71. Further, as illustrated in FIG. 2, a CPU (Central Processing Unit) of the system controller 71 sequentially outputs an output to a drive device such as a photoconductor motor, and bias outputs for respective image forming processes such as a charge bias. A color image signal input by an external device is subjected to image processing such as color conversion processing by an image signal generation circuit of the system controller 71, and an image signal for the Bk color is output to the exposure unit 33Bk. In the exposure unit 33Bk, on the basis of an optical signal converted from the image signal for the Bk color by an exposure drive circuit of the system controller 71, an exposure laser diode scans the photoconductor 31Bk while flashing on and off. Thereby, an exposure operation is performed, and an electrostatic latent image is formed.

The electrostatic latent image formed on the photoconductor 31Bk is developed into a Bk toner image by the development unit 34Bk. Then, the Bk toner image formed on the photoconductor 31Bk is transferred onto the intermediate transfer belt 21 by the first transfer unit 35Bk. After the transfer of the toner image, residual toner remaining on the photoconductor 31Bk is cleaned off by the cleaning unit 36Bk. Then, the photoconductor 31Bk is neutralized by a neutralizing lamp (not illustrated) to prepare for a next image forming operation.

Similarly, each of the image forming units 30Y, 30M, and 30C includes, for example, a charging unit, a development unit, a cleaning unit, and a neutralizing lamp around the corresponding one of photoconductors 31Y, 31M, and 31C. The photoconductors 31Y, 31M, and 31C are formed with a Y toner image, an M toner image, and a C toner image, respectively. The Y toner image, the M toner image, and the C toner image are then superimposed and transferred onto the intermediate transfer belt 21 in a first transfer process.

Below the image forming units 30Y, 30M, 30C, and 30Bk for the respective colors, the transfer unit 20 constituting a transfer device is disposed. The transfer unit 20 includes, for example, the loop-like intermediate transfer belt 21, driven rollers 22 and 23, and a drive roller 24. The intermediate transfer belt 21 constituting an image carrying member for carrying thereon the toner images of the plurality of colors is stretched with tension over the drive roller 24, the driven rollers 22 and 23, and so forth. The intermediate transfer belt 21 is formed by a material of extremely high smoothness to prevent toner fixation to the belt. For example, a belt material having a lustrous surface made of PVDF (polyvinylidene-fluoride), polyimide, or the like can be preferably used to form the intermediate transfer belt 21.

As the drive roller 24 is driven to rotate by the drive mechanism unit (not illustrated) including motors and so forth under the control of the system controller 71 illustrated in FIG. 2, the intermediate transfer belt 21 is driven to rotate in the counter-clockwise direction in FIG. 1. The Y, M, C, and Bk toner images formed on the photoconductors 31Y, 31M, 31C, and 31Bk for the respective colors are superimposed and transferred onto the intermediate transfer belt 21 in the first transfer process at first transfer nips for the respective colors. Thereby, a four-color superimposed toner image (hereinafter referred to as the four-color toner image) is formed on the intermediate transfer belt 21.

A portion of the outer surface of the intermediate transfer belt 21 passing over the drive roller 24 is in contact with a second transfer bias roller 61. With this configuration, a second transfer nip 6 is formed. As illustrated in FIG. 2, the second transfer bias roller 61 is applied with a second transfer bias by a bias power supply circuit under the control of the system controller 71. Thereby, a second transfer electric field is generated between the second transfer bias roller 61 and the grounded drive roller 24, which is on a back side of the second transfer nip 6. As the intermediate transfer belt 21 circularly moves, the four-color toner image formed on the intermediate transfer belt 21 enters the second transfer nip 6.

The sheet-feeding unit 10 sends recording sheets (transfer sheets) 12 stored in a sheet-feeding cassette 11 to a registration roller pair, while separating the recording sheets 12 one by one with the use of a sheet-feeding roller 11*a* and separation members 11*b*, for example. Then, the registration roller pair sends each of the recording sheets 12 to the second transfer nip 6 at a predetermined timing, while adjusting the timing of sending the recording sheet 12 conveyed from the sheet-feeding cassette 11. At the second transfer nip 6, the four-color toner image on the intermediate transfer belt 21 is transferred at one time onto the recording sheet 12 in a second transfer process by the action of the second transfer electric field and nip pressure. Thereby, the four-color toner image is blended with the white color of the recording sheet 12 to form a full-color image.

The recording sheet 12 thus formed with the full-color image is then conveyed to the fixing unit 40. In the fixing unit 40, the recording sheet 12 formed with the full-color image is applied with heat and pressure by a fixing roller 41 and a pressure roller 42, respectively. Thereby, the toners of the respective colors are fixed on the recording sheet 12, and the recoding sheet 12 is discharged onto a sheet-discharging tray (not illustrated) by a sheet-discharging roller pair (not illustrated).

Figure 3:
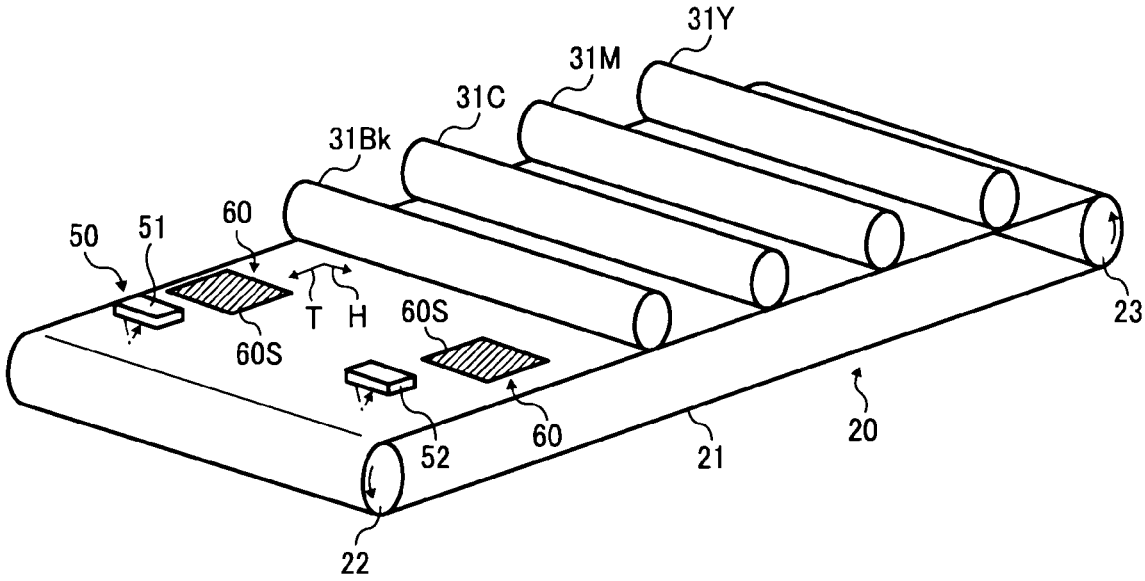
FIG. 3 is a perspective view of essential parts illustrating a configuration example of pattern images and optical sensors on an intermediate transfer belt of the image forming apparatus.
Figure 4A:
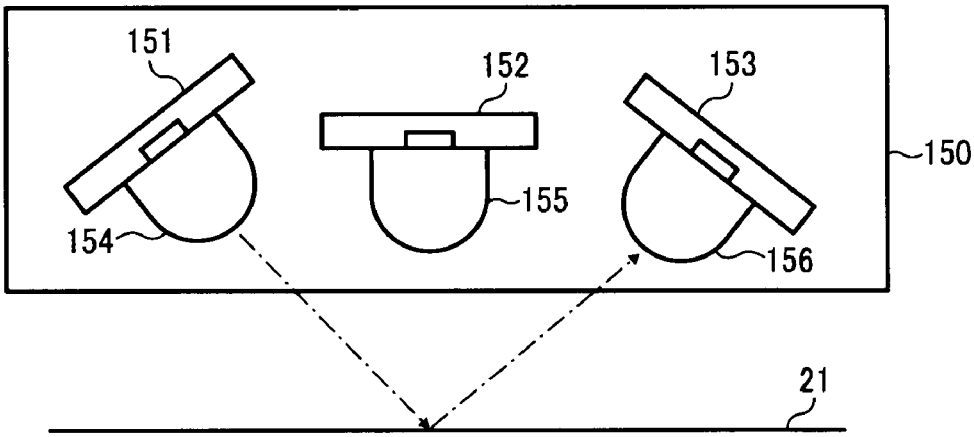
FIG. 4A is a diagram for explaining detection on a surface of the intermediate transfer belt by the optical sensor.
Figure 4B:
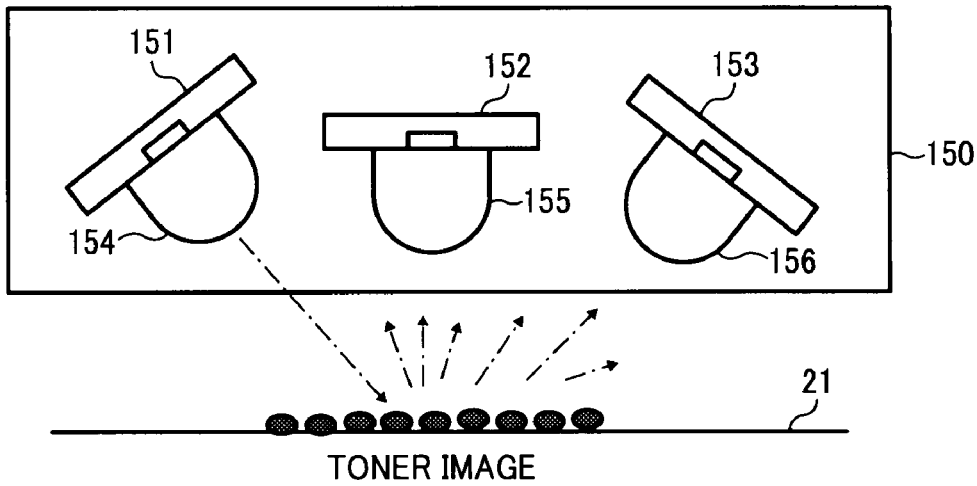
FIG. 4B is a diagram for explaining detection of a toner image on the surface of the intermediate transfer belt by the optical sensor.

The adhesion amount detection unit 50 is provided downstream of the image forming unit 30Bk for the Bk color in the moving direction of the intermediate transfer belt 21. As illustrated in FIG. 3, the adhesion amount detection unit 50 includes a pair of optical sensors 51 and 52 disposed in the width direction of the intermediate transfer belt 21 and constituting an optical detection device. As illustrated in FIGS. 4A and 4B, each of the optical sensors 51 and 52 includes a light-emitting element 151 including, for example, a light-emitting diode, a first light-receiving element 152 for receiving irregularly reflected light, and a second light-receiving element 153 for receiving regularly reflected light. Each of the first light-receiving element 152 and the second light-receiving element 153 includes a Si phototransistor or a PD (photodiode), for example. The light-emitting element 151, the first light-receiving element 152, and the second light-receiving element 153 are mounted on a printed board 150. Further, a condenser lens 154 is provided on an emitted light path so that light emitted from the light-emitting element 151 is refracted by the condenser lens 154 and condensed on a radiation target on the surface of the intermediate transfer belt 21 constituting the image carrying member. Further, condenser lenses 155 and 156 are provided on incident light paths. Thus, reflected light reflected by the toner, i.e., the radiation target, on the intermediate transfer belt 21 is condensed by the condenser lenses 155 and 156 and received by the first and second light-receiving elements 152 and 153. The printed board 150 is connected to the system controller 71. The light-emitting element 151 is applied with a voltage adjusted by a light amount adjustment circuit of the system controller 71 illustrated in FIG. 2. Further, the system controller 71 performs a conversion process of converting output signals from the first and second light-receiving elements 152 and 153 into digital signals through an AD (Analog-to-Digital) converter.

Figure 5:
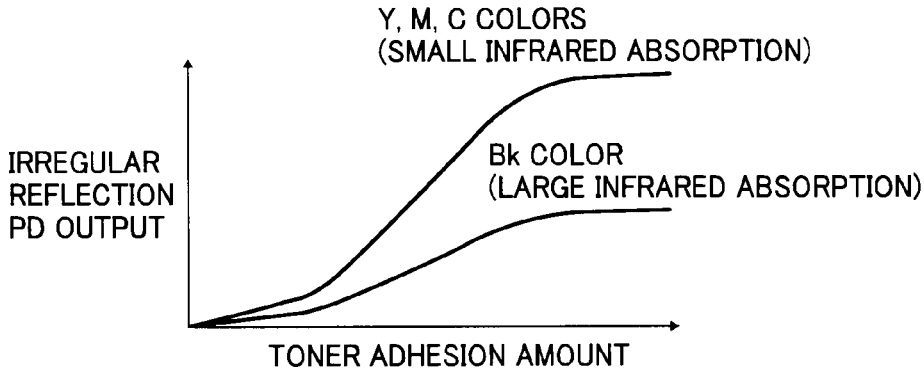
FIG. 5 is a diagram illustrating the relationship between an output value of the optical sensor and a toner adhesion amount.

As the optical sensors 51 and 52 of the present embodiment, an optical sensor capable of detecting at least one of near-infrared light and infrared light is used. Near-infrared light and infrared light are unaffected by a toner colorant. Thus, if the toner images have the same toner adhesion amount, the output values of the light-receiving elements are substantially the same. Specifically, the present embodiment employs an optical element which radiates light having a peak emission wavelength of approximately 840 nm (nanometers), and a light-receiving element having a peak spectral sensitivity of approximately 840 nm. Alternatively, for example, the present embodiment may employ a light-emitting element which radiates light ranging from visible light to infrared light, and a light-receiving element which receives near-infrared light or infrared light. Still alternatively, the present embodiment may employ a light-receiving element which receives light ranging from visible light to infrared light, and a light-emitting element which radiates near-infrared light or infrared light. The thus configured optical sensor can also function as the optical sensor for detecting near-infrared light or infrared light. If inexpensive carbon black is used as the colorant of the Bk toner, adhesion amount detection sensitivity is lower in the Bk color than in the other colors Y, M, and C, as illustrated in FIG. 5, since carbon has high light absorption even in an infrared region.

In the color image forming apparatus 1 according to the present embodiment, a process adjustment operation of adjusting the development bias, the charge bias, the exposure amount, and so forth is performed upon power-on or in the printing on a predetermined number of sheets so that the image density of each of the colors is adjusted to an appropriate value.

An image forming apparatus according to an electrophotographic method has a disadvantage in that the image density is changed by such factors as the time degradation and the environmental change. Thus, the above-described process adjustment operation is performed to control the image density to be stabilized.

Figure 6:
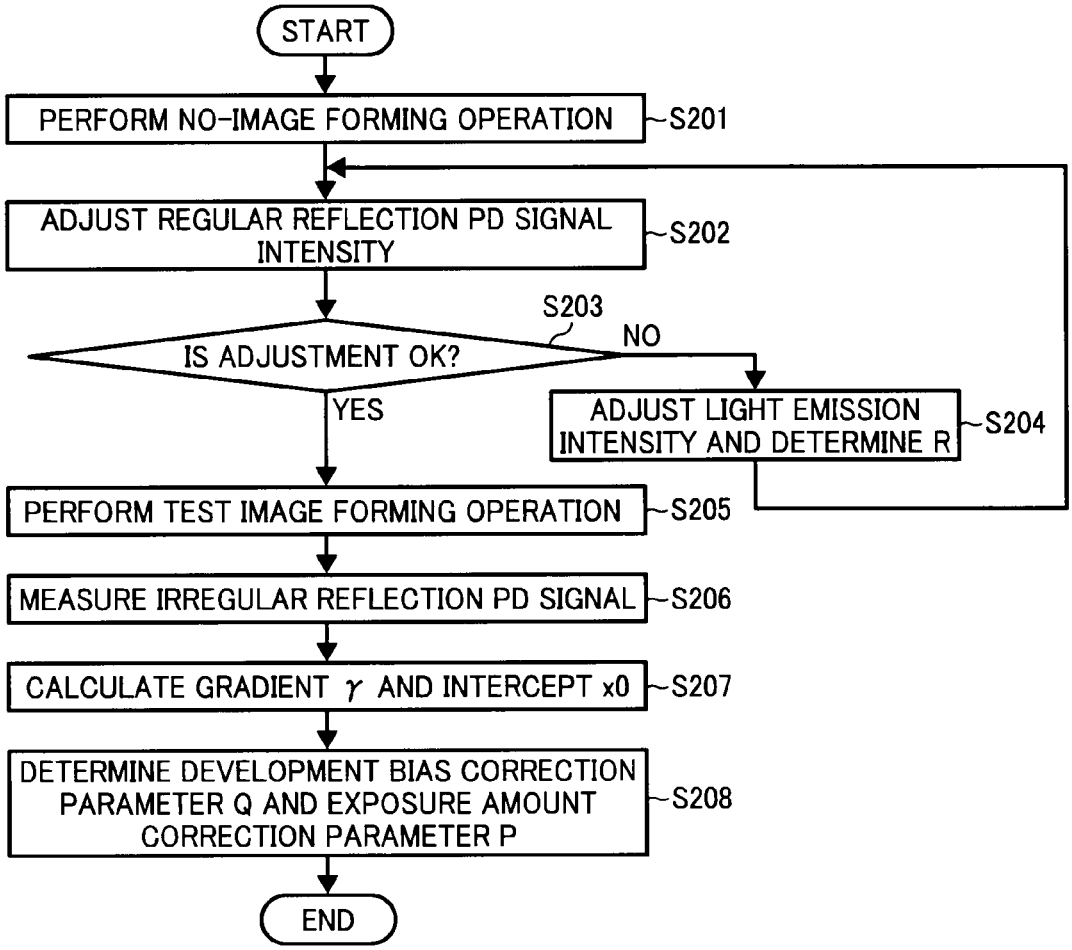
FIG. 6 is a control flow diagram of a process adjustment operation.

A control flow of the process adjustment operation is illustrated in FIG. 6.

Upon power-on or before and after the printing on a predetermined number of sheets, a process adjustment operation signal is issued by the upper control device to the system controller 71, and the process adjustment operation starts (see FIG. 2).

Figure 7:
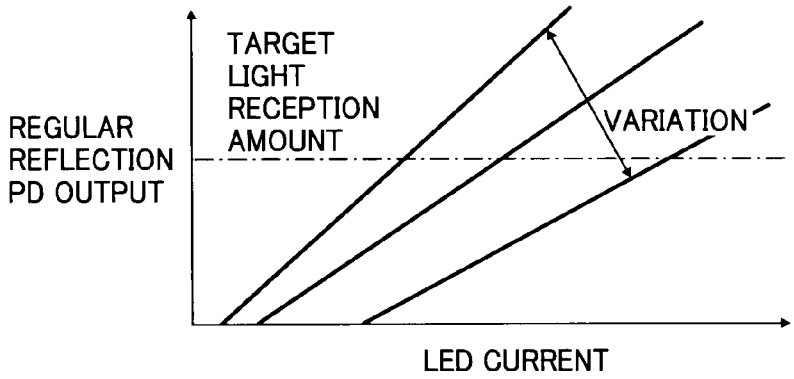
FIG. 7 is a diagram illustrating the relationship between the output value of the optical sensor and an output value of a light-emitting element (LED)

As the process adjustment operation starts, the system controller 71 brings the image signal generation circuit into a state in which the circuit has no image to form (Step S201). Then, as illustrated in FIG. 4A, the CPU of the system controller 71 causes light radiation to the intermediate transfer belt 21, and resultant regularly reflected light is received by the second light-receiving element 153. Then, the light amount adjustment circuit adjusts a light emission intensity R of the light-emitting element 151 of each of the optical sensors 51 and 52 such that the output from the second light-receiving element 153 (i.e., a received light signal) has a predetermined value (Steps S202 to S204). As illustrated in FIG. 7, the output value of the second light-receiving element 153 varies due to such factors as the individual difference in luminous efficiency of the light-emitting element 151, the change in temperature, and the change over time. Thus, if the light emission intensity R of the light-emitting element 151 is adjusted such that the output value of the second light-receiving element 153 is equal to the target output value, the density of a toner image can be accurately measured. That is, the processes of Steps S202 to S204 correspond to a correction operation of the optical sensors 51 and 52 for enabling the optical sensors 51 and 52 to accurately measure the adhesion amount of a toner image.

Figure 8:
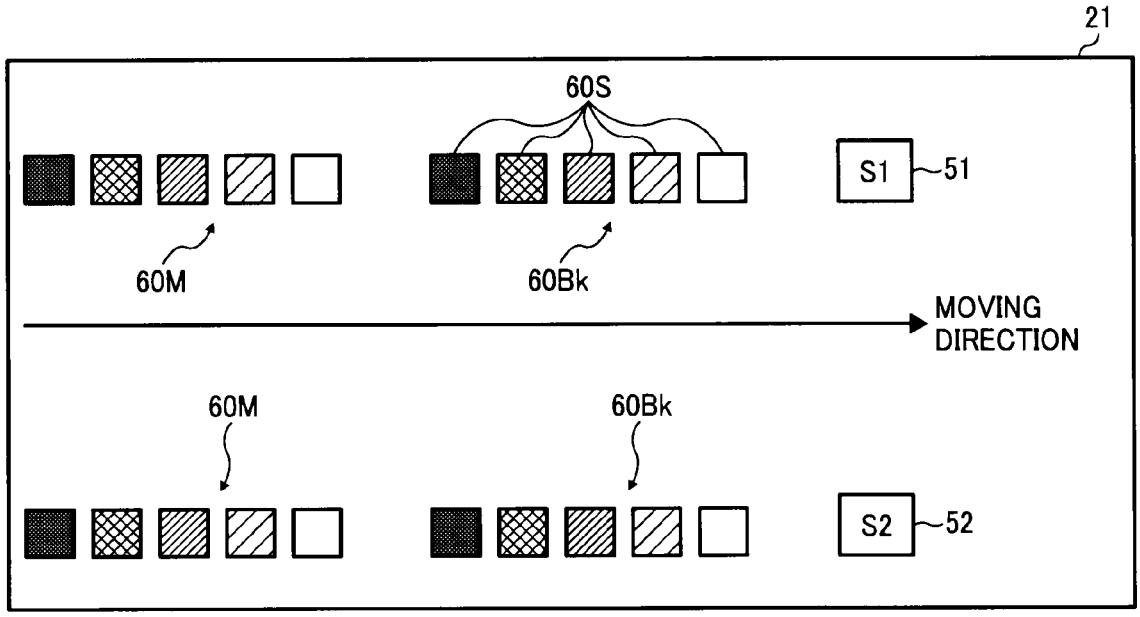
FIG. 8 is a diagram illustrating pattern images formed on the intermediate transfer belt.

Following the above-described correction operation of the optical sensors 51 and 52, pattern images 60 as illustrated in FIG. 8 are automatically formed on the intermediate transfer belt 21 at positions facing the respective optical sensors 51 and 52 (Step S205). Each of the pattern images 60 includes approximately five patch images 60S which are different in density level. Pattern images 60Bk for the Bk color, pattern images 60M for the M color, pattern images 60C (not illustrated) for the C color, and pattern images 60Y (not illustrated) for the Y color are sequentially formed on the intermediate transfer belt 21. The patch images 60S are formed with different exposure conditions. In the formation of the patch images 60S, each of the charge bias condition and the development bias condition is set to a predetermined value. Then, the pattern images 60 formed on the intermediate transfer belt 21 are optically measured by the optical sensors 51 and 52, as illustrated in FIG. 4B (Step S206).

Then, with the use of an adhesion amount calculation algorithm constructed on the basis of the relationship between the adhesion amount and the output value of the light-receiving element as illustrated in foregoing FIG. 5, a conversion process is performed on the received light signals at five points of the first light-receiving element 152, which receives irregularly reflected light obtained through the detection of the respective patch images 60S of the pattern images 60 of the respective colors. Thereby, the received light signals are converted into the toner adhesion amounts (i.e., the image densities). Accordingly, the toner adhesion amounts of the respective patch images 60S are detected. The present embodiment employs the optical sensors using at least one of near-infrared light and infrared light. Thus, the output value of the first light-receiving element 152 does not vary depending on the color. Therefore, there is not need to prepare the adhesion amount calculation algorithm for each of the colors. That is, a common adhesion amount calculation algorithm can be used. If carbon black is used as the colorant of the Bk color, the output value of the light-receiving element with respect to the adhesion amount is different between the Bk color and the other colors Y, M, and C, as illustrated in foregoing FIG. 5. In such a case, therefore, two adhesion amount calculation algorithms, i.e., one for the Y, M, and C colors and the other for the Bk color, are used.

Figure 9:
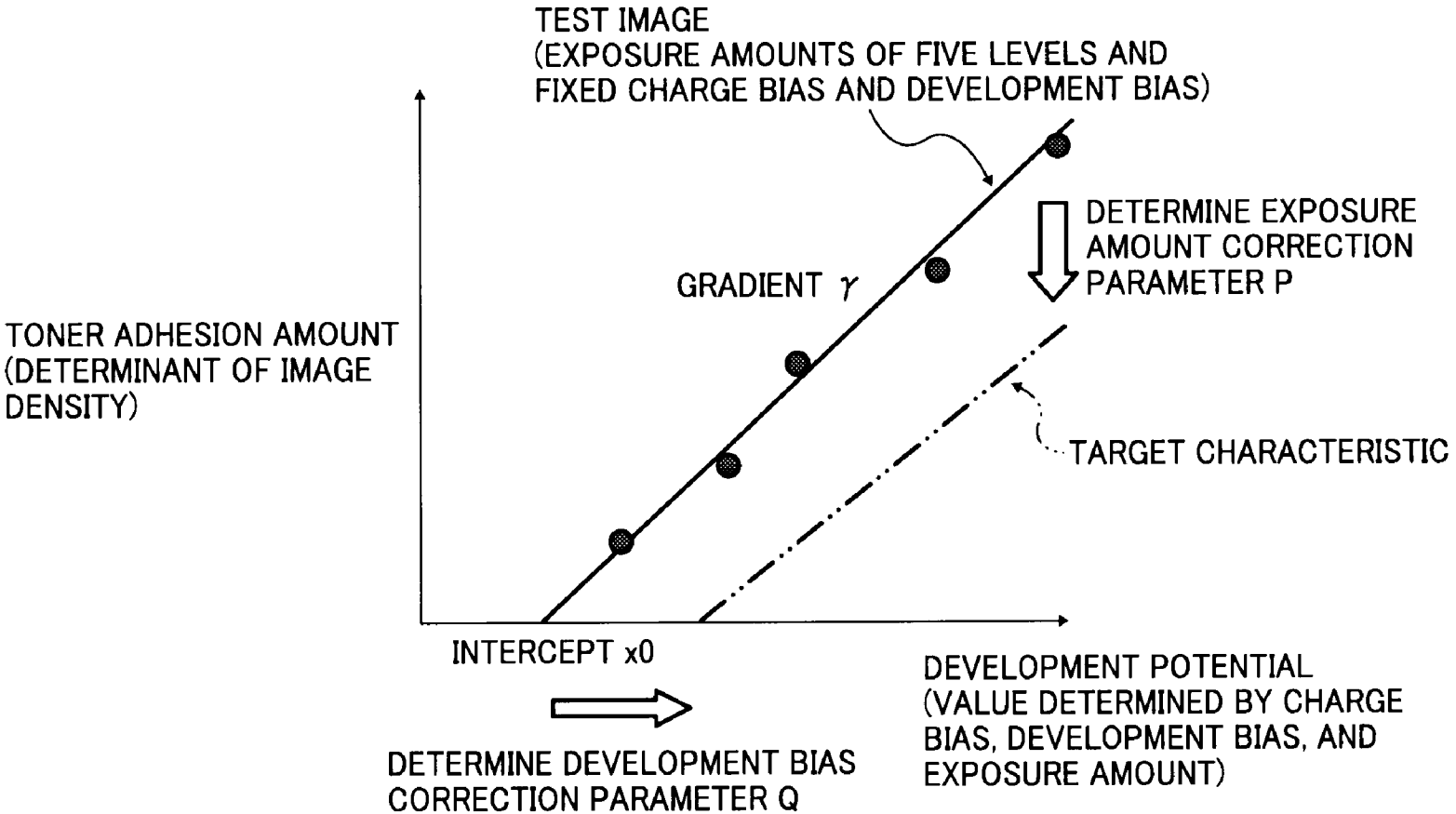
FIG. 9 is a diagram for explaining a process adjustment method.

Following the detection of the toner adhesion amounts of the respective patch images 60S of the respective colors, a straight line representing the relationship between the development potential and the toner adhesion amount is obtained for each of the colors from linear approximation, as illustrated in FIG. 9, on the basis of the relationship between the toner adhesion amount of each of the patch images 60S and the development potential used in the formation of the patch image 60S. Then, from the straight line representing the relationship between the development potential and the toner adhesion amount, a gradient $\gamma$ and an intercept x0 are calculated for each of the colors (Step S207). With the gradient $\gamma$ and the intercept x0 thus calculated for each of the colors, it is possible to detect the deviation of the gradient $\gamma$ and the intercept x0 of the straight line from the target characteristic indicated by the broken line in FIG. 9, which is caused by the above-described density changing factors such as the time degradation and the environmental change. Then, an exposure amount correction parameter P for correcting the deviation of the gradient $\gamma$ is determined on the basis of the gradient $\gamma$. Further, a development bias correction parameter Q for correcting the deviation of the development potential with which the development operation starts (i.e., the intercept x0) is determined on the basis of the intercept x0 (Step S208).

The gradient $\gamma$ is mainly corrected by multiplication of an exposure signal by the exposure amount correction parameter P, and the intercept x0 is mainly corrected by multiplication of the development bias by the development bias correction parameter Q. With the above corrections, the target image density can be steadily obtained. In the above description, the exposure amount and the development bias are corrected. Alternatively, other process control values contributing to the image density, such as a charge potential and a transfer current, may be corrected.

Characteristics of the present embodiment will now be described. The above-described process adjustment operation is performed for the purpose of correcting the variation of the image density (i.e., the toner adhesion amount) due to a change in the toner charge amount within a normal range and a change in the photoconductor sensitivity within a normal range, for example, which are caused by a change in temperature or humidity, for example. The present inventors have found that, if a failure or a sign of failure occurs in one of the image forming units 30 constituting the toner image forming devices, a change occurs in the toner adhesion amounts of the patch images 60S formed by the image forming units 30 other than the image forming unit 30 having the failure or the sign of failure. Specific description thereof will be made below.

Figure 10A:
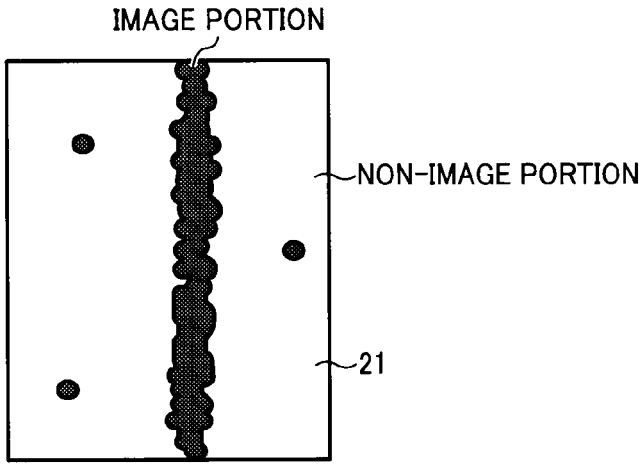
FIG. 10A is a diagram for explaining a state of the surface of the intermediate transfer belt when there is no sign of failure in an image forming unit.

In the image forming unit 30 of the present embodiment, the cleaning unit 36 for cleaning the surface of the photoconductor 31 employs a blade cleaning method of bringing a blade member such as a urethane rubber blade into contact with the photoconductor 31 to scrape off transfer residual toner not transferred to the intermediate transfer belt 21 but remaining on the photoconductor 31. In the blade cleaning method, a portion of the transfer residual toner slips under the blade member and passes through the cleaning unit 36. A high proportion of the transfer residual toner thus having passed through the cleaning unit 36 passes through the charging unit 32 and the exposure unit 33 and is collected by the development unit 34. However, a portion of the transfer residual toner thus having passed through the cleaning unit 36 is changed in shape or loses a charging characteristic due to the frictional charging by the blade member when the toner passes through the blade member, and thus fails to be collected by the development unit 34. The transfer residual toner thus having failed to be collected by the development unit 34 moves to the first transfer unit 35 and adheres to the intermediate transfer belt 21. In a normal state, the transfer residual toner moving to the first transfer unit 35 for the above-described reason is extremely small in amount. As illustrated in FIG. 10A, therefore, an extremely small amount of the transfer residual toner having passed through the cleaning unit 36 adheres to the overall surface of the intermediate transfer belt 21. Therefore, the image quality is not significantly deteriorated.

Meanwhile, if the blade member is abraded due to long time use thereof, the scraping performance of the blade member is deteriorated, and the toner passing through the blade member tends to increase at an accelerating pace. Further, if the toner fails to be charged in a desired manner due to the degradation of the development unit 34 or a developer, the amount of the transfer residual toner not transferred to the intermediate transfer belt 21 but conveyed to the blade member is increased. If the amount of the transfer residual toner conveyed to the blade member is thus increased, the amount of the transfer residual toner passing through the blade member tends to increase. Then, a relatively large amount of the transfer residual toner eventually passes through a part of the blade member while leaving a streak of the toner. The relatively large amount of the transfer residual toner having passed through the blade member adheres to and smears the charging unit 32, and thus deteriorates the charging performance. Further, due to the relatively large amount of the transfer residual toner on the photoconductor 31, the exposure unit 33 fails to attenuate the surface potential of the photoconductor 31 to a predetermined potential. As a result, an abnormal image is generated. Furthermore, the development unit 34 cannot collect the relatively large amount of the transfer residual toner. Thus, the transfer residual toner stretching in the form of a streak is transferred to the intermediate transfer belt 21, and an abnormal image having a longitudinal streak is formed on the intermediate transfer belt 21. The image forming unit 30 no longer capable of forming a normal image requires immediate repair.

Figure 10B:
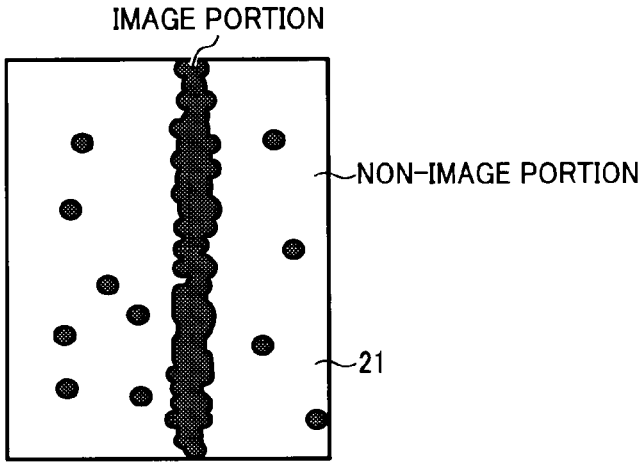
FIG. 10B is a diagram for explaining a state of the surface of the intermediate transfer belt when there is the sign of failure in the image forming unit.
Figure 11:
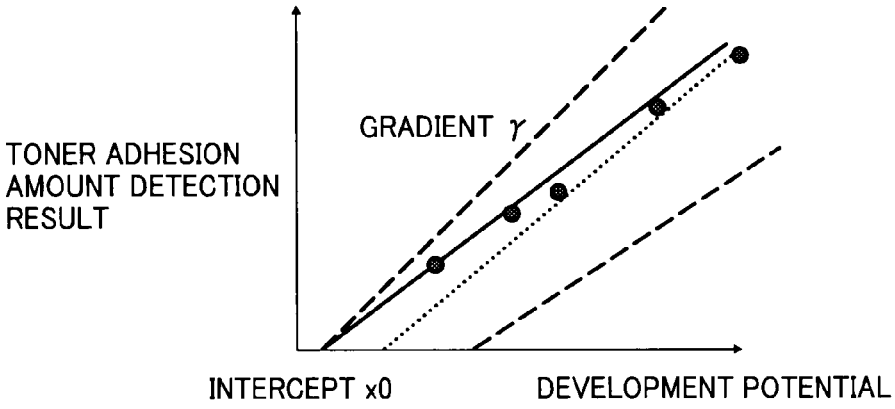
FIG. 11 is a diagram illustrating a straight line representing the relationship between a development potential and the toner adhesion amount when there is the sign of failure in an image forming unit for a Bk color.

A little while before the image forming unit 30 requires such repair, the amount of the transfer residual toner uniformly adhering to the overall surface of the intermediate transfer belt 21 is increased, as illustrated in FIG. 10B. As a result, the amount of the transfer residual toner adhering to a non-image area is also increased. Such a phenomenon in which toner adheres to the non-image area is referred to as scumming. The scumming occurring in the above-described state is of a moderate degree, and the image deterioration caused by the scumming does not disturb the user. Therefore, the user rarely notices the image deterioration. The above-described scumming is hereinafter referred to as moderate scumming. From the process adjustment operation performed in the state of the moderate scumming, which is a sign of failure in the cleaning unit 36 or the development unit 34, it was found that the adhesion amount detection result obtained through the detection by the optical sensors 51 and 52 of the patch images 60S formed by the image forming unit 30 having the sign of failure in the cleaning unit 36 or the development unit 34 is slightly higher than the target characteristic in a low-density portion. As a result, as illustrated in FIG. 11, a slight decrease in the gradient γ and a slight decrease in the intercept x0 are caused in the straight line representing the relationship between the development potential and the toner adhesion amount obtained from the adhesion amount detection result obtained through the detection by the optical sensors 51 and 52 of the patch images 60S formed by the image forming unit 30 having the sign of failure in the cleaning unit 36 or the development unit 34. Therefore, there is no significant deviation from a general range of variation caused by changes in the toner and the photoconductor due to environmental and temporal factors (i.e., the range indicated by the broken lines in FIG. 11). The changes in the gradient γ and the intercept x0 calculated on the basis of the adhesion amount detection result obtained through the detection by the optical sensors 51 and 52 of the patch images 60S formed by the image forming unit 30 subjected to the failure determination, and the exposure amount correction parameter P and the development bias correction parameter Q determined on the basis of the gradient γ and the intercept x0, have been considered to change in accordance with the degradation of the toner characteristic, the photoconductor characteristic, the charging device, and the development device. Thus, the failure of the image forming unit 30 has been determined on the basis of the gradient γ, the intercept x0, the exposure amount correction parameter P, and the development bias correction parameter Q. It was found, however, that the sign of failure in the cleaning unit 36 or the development unit 34 cannot be obtained from the changes in the gradient γ and the intercept x0 calculated on the basis of the adhesion amount detection result obtained through the detection by the optical sensors 51 and 52 of the patch images 60S formed by the image forming unit 30 subjected to the failure determination, and the changes in the exposure amount correction parameter P and the development bias correction parameter Q determined on the basis of the gradient γ and the intercept x0. As a result, it was found that accurate failure prediction cannot be performed on the basis of the above-described changes.

FIGS. 12A to 12D are diagrams illustrating straight lines representing the relationships between the development potentials and the toner adhesion amounts of the respective colors when the image forming unit 30Bk for the Bk color has the sign of failure in the cleaning unit 36Bk or the development unit 34Bk. The diagrams illustrate the results obtained when the Bk toner contains carbon black as the colorant.

As described above, in the straight line representing the relationship between the development potential and the toner adhesion amount obtained from the adhesion amount detection result obtained through the detection by the optical sensors 51 and 52 of the patch images 60S of the Bk color having the sign of failure, the adhesion amount of a low-density portion is slightly higher than the target characteristic, and a slight decrease in the gradient γ and a slight decrease in the intercept x0 occur. This is considered to be due to the following reason. That is, a low-density patch image includes a relatively large non-development area, and thus the transfer residual toner adhering to a portion on the photoconductor 31 not subjected to the development is transferred to the intermediate transfer belt 21. Therefore, the toner adhesion amount of the low-density patch image is slightly increased. Meanwhile, a high-density patch image includes a relatively small non-development area, and thus most of a portion on the photoconductor 31 adhered with the transfer residual toner is subjected to the development. In the development process, toner is unlikely to adhere to the portion on the photoconductor 31 already adhered with the transfer residual toner due to such factors as the charge potential of the toner. After the development process, therefore, the portion on the photoconductor 31 adhered with the transfer residual toner becomes substantially the same in the toner adhesion amount as the portion on the photoconductor 31 not adhered with the transfer residual toner and subjected to the development. As a result, the toner adhesion amount of the high-density patch image is considered to have substantially the same value as the value of the target characteristic.

Meanwhile, the detection of the patch images 60S of the Y, M, and C colors by the optical sensors 51 and 52 brought a detection result in which the adhesion amount is higher than the target characteristic in a low-density portion and is lower than the target characteristic in a high-density portion. In the Y, M, and C colors, therefore, the gradient γ and the intercept x0 substantially deviated from the target characteristic, and were substantially different from the variation caused by changes in the toner and the photoconductor due to environmental and temporal factors. Accordingly, the sign of failure in the cleaning unit 36Bk or the development unit 34Bk for the Bk color can be obtained from the gradient γ and the intercept x0 of each of the Y, M, and C colors or the changes in the exposure amount correction parameter P and the development bias correction parameter Q determined on the basis of the gradient γ and the intercept x0.

As described above, the detection of the patch images 60S of the Y, M, and C colors by the optical sensors 51 and 52 brought the detection result in which the adhesion amount is higher than the target characteristic in the low-density portion and lower than the target characteristic in the high-density portion. This is considered to be due to the following reason. As illustrated in FIG. 1, the image forming unit 30Bk for the Bk color is provided at the most downstream position in the moving direction of the intermediate transfer belt 21. Therefore, the transfer residual toner of the Bk color which has moved to the first transfer unit 35Bk for the Bk color due to the failure of the cleaning unit 36Bk or the development unit 34Bk is transferred onto the patch images 60S of the Y, M, and C colors formed on the intermediate transfer belt 21. In a low-density patch image 60S, the adhesion amount detection result obtained by the optical sensors 51 and 52 is slightly higher than the target characteristic due to the adhesion of the transfer residual toner of the Bk color to a portion on the intermediate transfer belt 21 not adhered with toner. Meanwhile, in a high-density patch image 60S, the transfer residual toner of the Bk color adheres onto the toners of the Y, M, and C colors adhering to the intermediate transfer belt 21. Since the toner of the Bk color contains carbon black as the colorant, the toner absorbs infrared light. Thus, the output value of the optical sensors 51 and 52 is reduced, as illustrated in FIG. 5. Therefore, the transfer residual toner of the Bk color adhering onto the toners of the Y, M, and C colors absorbs infrared light emitted from the light-emitting element 151 of each of the optical sensors 51 and 52, and the amount of the reflected light reflected by the toners is reduced. As a result, the output value of the optical sensors 51 and 52 is reduced, and the adhesion amount detection result calculated on the basis of the relationship between the adhesion amount of the toners of the Y, M, and C colors and the output value of the optical sensors 51 and 52 illustrated in FIG. 5 is lower than the target characteristic. Accordingly, the adhesion amount detection result of the toners of the Y, M, and C colors is higher than the target characteristic in the low-density portion and lower than the target characteristic in the high-density portion.

As described above, the present inventors have found that, when the image forming unit 31Bk for the Bk color shows the sign of failure, a change occurs in the adhesion amount detection result of the Bk color obtained by the optical sensors 51 and 52, and also in the adhesion amount detection results of the other colors Y, M, and C obtained by the optical sensors 51 and 52. In the present embodiment, therefore, to grasp the failure state of the image forming unit 30Bk for the Bk color, failure determination is performed in which an development bias correction parameter Q(K) obtained from the adhesion amount detection results of the respective patch images 60S of the Bk color and development bias correction parameters Q(Y), Q(M), and Q(C) obtained from the adhesion amount detection results of the respective patch images 60S of the Y, M, and C colors are used as operation control information.

Figure 13:
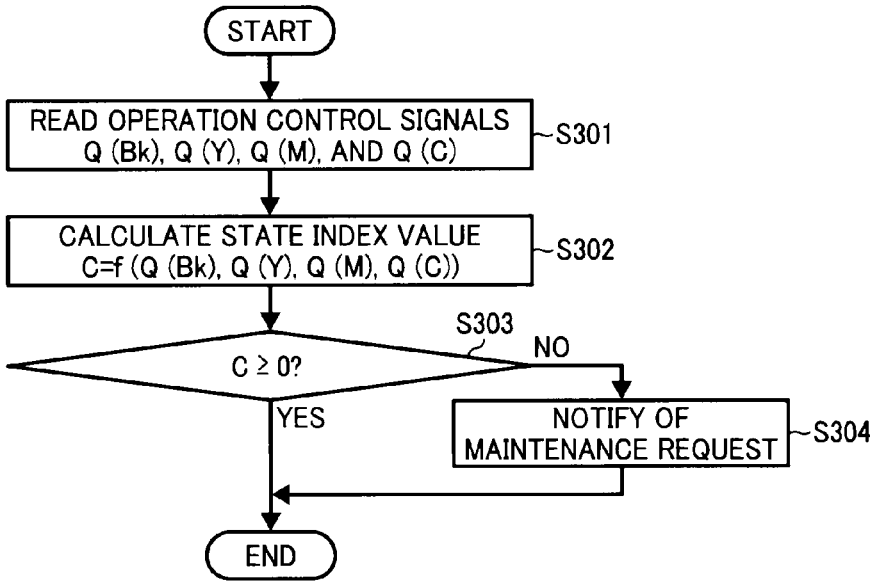
FIG. 13 is a control flow diagram of a failure determination operation.
Figure 14:
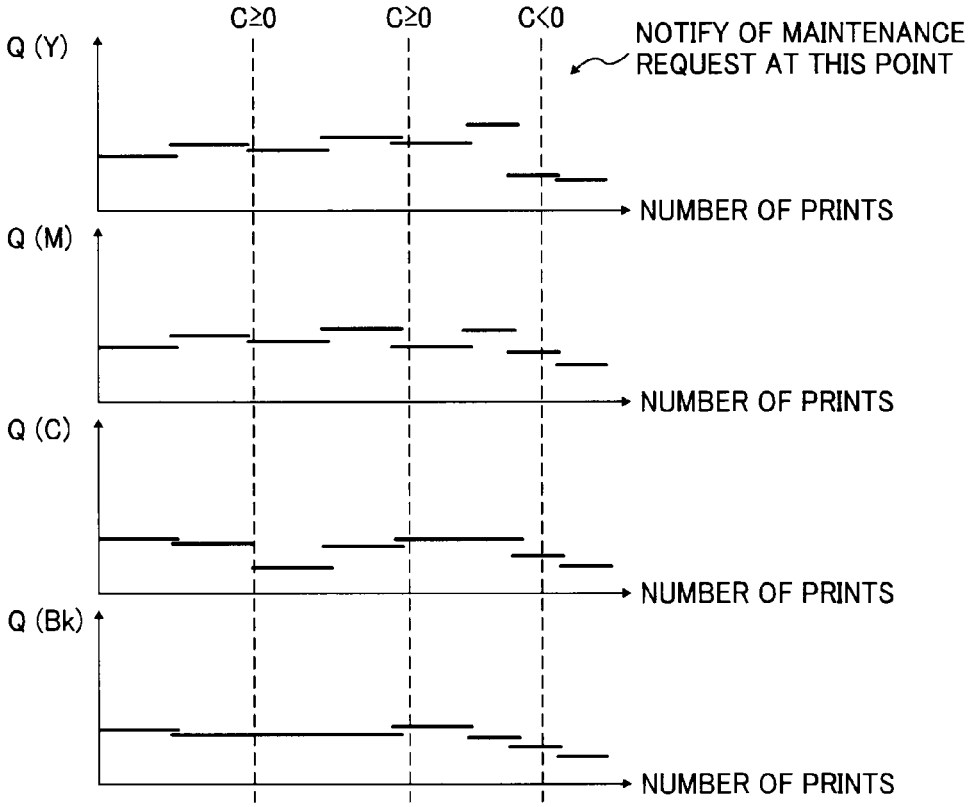
FIG. 14 is a diagram illustrating an example of the relationship between an index value C and the values of operation control information sets Q(Y), Q(M), Q(C), and Q(Bk)

The failure determination according to the present embodiment will now be described with reference to FIGS. 13 and 14. A failure determination algorithm illustrated in FIGS. 13 and 14 uses a linear binding equation. To perform the failure determination of the image forming unit 30Bk for the Bk color, the development bias correction parameters for the respective colors Q(Bk), Q(Y), Q(M), and Q(C) are read from a memory (Step S301). Then, the values of the development bias correction parameters Q(Bk), Q(Y), Q(M), and Q(C) are substituted in a linear binding equation $C(Bk)=aQ(Bk)+bQ(Y)+cQ(M)+dQ(C)$ to calculate a state index value C (Step S302). In the equation, a to d represent weighting parameters. The weighting parameters a to d are determined, for example, such that the relationship $C<0$ is established when the values of the development bias correction parameters Q(Bk), Q(Y), Q(M), and Q(C) are all on the decline and each of the values of the development bias correction parameters Q(Y), Q(M), and Q(C) is equal to or smaller than a predetermined value, as illustrated in FIG. 14.

If the failure is determined (i.e., $C<0$) in the above-described failure determination (NO at Step S303), the system controller 71 notifies of a maintenance request on a display panel of the color image forming apparatus 1 or on a display screen of an external device such as a personal computer (Step S304). Alternatively, communication may be established between the color image forming apparatus 1 and a service center to notify the service center of the need for maintenance.

In the present embodiment, the failure of the image forming unit 30 is comprehensively predicted from the four values of the development bias correction parameters Q(Y), Q(M), Q(C), and Q(Bk) (hereinafter referred to as the Q values) of the colors Y, M, C, and Bk. Thus, the present embodiment can better prevent accidental erroneous report of the failure than the method of predicting the failure of the image forming unit from a single value.

The above-described example solely uses the Q values to calculate the state index value C. Alternatively, if the values of the exposure amount correction parameter P and other parameters are used as well as the Q values to calculate the state index value C, the accidental erroneous report of the failure can be further better prevented.

The method of constructing a calculation formula for calculating the state index value C may use an information technology widely and generally provided as a pattern recognition algorithm or a learning algorithm, such as an LDA (Linear Discriminant Analysis) method, a boosting method, and a support vector machine method, for example.

Further, the state index value C may be calculated not by the calculation simply using the Q values but by the calculation using a feature quantity calculated from chronological data of the Q values. From the feature quantity calculated from chronological data of the Q values and characterizing the temporal change of the Q values, it is possible to reliably determine whether or not the Q values of the Y, M, and C colors have been substantially reduced. Accordingly, the accuracy of the failure prediction in the image forming unit 30Bk for the Bk color is improved. The feature quantity includes, for example, a gradient S of a linear regression equation constructed from the chronological data of the Q values, and a coefficient of variation T obtained by calculating the standard deviation and the average value of the chronological data of the Q values and dividing the standard deviation by the average value. If the state index value C is calculated by the calculation additionally using the gradient S and the coefficient of variation T, the accuracy of the failure prediction in the image forming unit 30Bk for the Bk color is improved.

In the above-described example, the failure determination of the image forming unit 30Bk for the Bk color has been described. In the failure determination of the image forming units 30Y, 30M, and 30C for the other colors Y, M, and C, the development bias correction parameters Q of the other colors than the color of the image forming unit 30 subjected to the failure determination are used similarly as in the above-described example. With the use of the development bias correction parameters Q, it is possible to detect the sign of failure from the moderate scumming occurring in the toner of the color of the image forming unit 30 subjected to the failure determination. The failure determination of the image forming unit 30C for the C color will now be described as an example.

FIGS. 15A to 15D illustrate an example of straight lines representing the relationships between the development potentials and the toner adhesion amounts of the Y. M, and Bk colors when the C color shows the sign of failure.

Figure 15A:
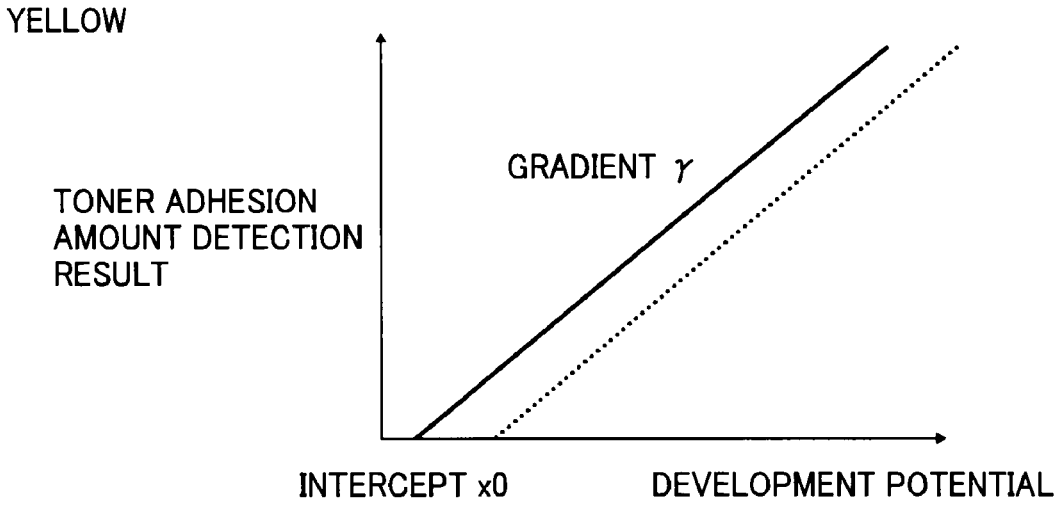
FIGS. 15A to 15D are diagrams illustrating straight lines representing the relationships between the development potentials and the toner adhesion amounts of the respective colors when there is the sign of failure in an image forming unit for a C color.
Figure 15B:
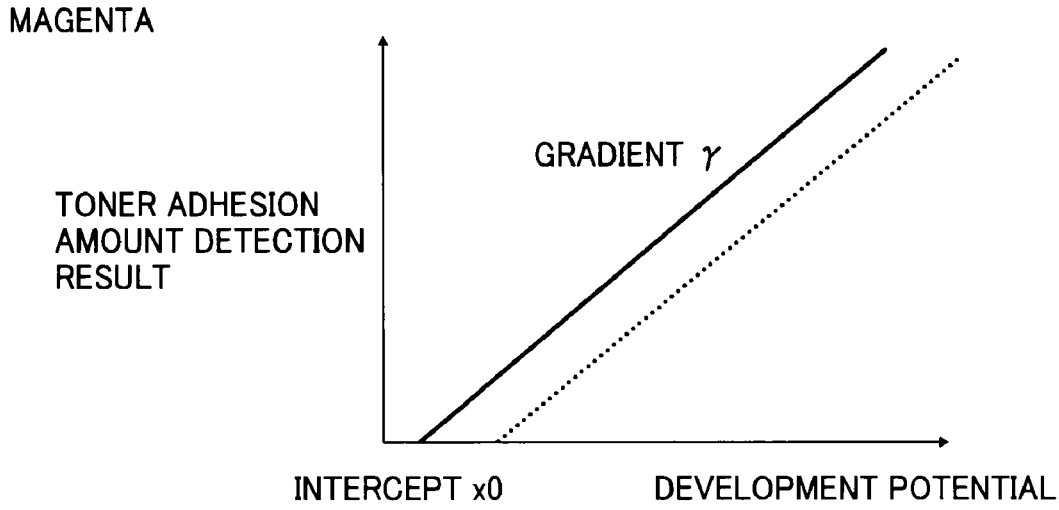
Figure 15C:
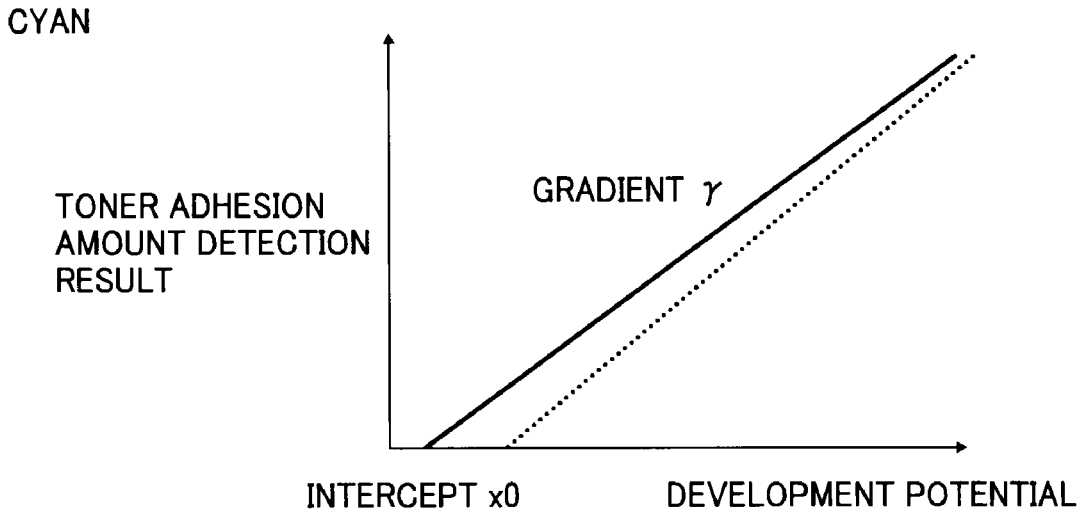

As illustrated in FIGS. 15A to 15D, in the adhesion amount detection result of the C color toner, the toner adhesion amount is slightly higher than the target characteristic indicated by the broken line in FIG. 15C in a low-density portion but substantially the same as the target characteristic in a high-density portion.

Meanwhile, the transfer residual toner of the C color adheres onto the patch images 60S of the Y and M colors. The Y, M, and C colors have the same sensor output value, as illustrated in foregoing FIG. 5. Thus, the adhesion amount detection results of the Y and M colors are higher than the target characteristic by the amount of the C color toner adhering onto the patch images 60S of the Y and M colors. As a result, the adhesion amount detection results of the toners of the Y and M colors are higher than the target characteristic by substantially the same amount in the low-density portion and the high-density portion.

Further, the patch images 60S of the Bk color are formed on the C color toner adhering onto the intermediate transfer belt 21 and causing the moderate scumming. As illustrated in foregoing FIG. 5, the C color toner does not absorb a large amount of infrared light. Thus, the amount of light reflected by the C color toner is larger than the amount of light reflected by the Bk color toner. As a result, the output value of the first light-receiving element 152 is increased, and the adhesion amount detection result calculated from the relationship illustrated in FIG. 5 between the adhesion amount and the output value of the light-receiving element of the Bk color is higher than the actual adhesion amount. Consequently, the adhesion amount detection result of the Bk color in the low-density portion is substantially increased.

As described above, if the image forming unit 30C for the C color has the sign of failure, the gradient $\gamma$ is substantially unchanged and only the decrease in the intercept x0 occurs in the Y and M colors, and the substantial change in the gradient $\gamma$ and the substantial decrease in the intercept x0 occur in the Bk color. Accordingly, if the information representing the above-described characteristics is used in the calculation of the state index value C as the operation control information, the failure occurring in the image forming unit 30C for the C color can be predicted.

If the Y color has the sign of failure, the gradient y is substantially unchanged and only the decrease in the intercept x0 occurs in the M and C colors. Further, if the M color has the sign of failure, the gradient $\gamma$ is substantially unchanged and only the decrease in the intercept x0 occurs in the Y and C colors. As for the Bk color, the Y, M, and C colors have the same result.

If the colorant of the Bk color toner does not contain carbon black, and if the image forming unit 30Bk for the Bk color has the sign of failure, the gradient $\gamma$ is substantially unchanged and only the decrease in the intercept x0 occurs in all of the Y, M, and C colors. Further, if any one of the image forming units 30Y, 30M, and 30C for the Y, M, and C colors has the sign of failure, the gradient $\gamma$ is substantially unchanged and only the decrease in the intercept x0 occurs in the Bk color.

Figure 12A:
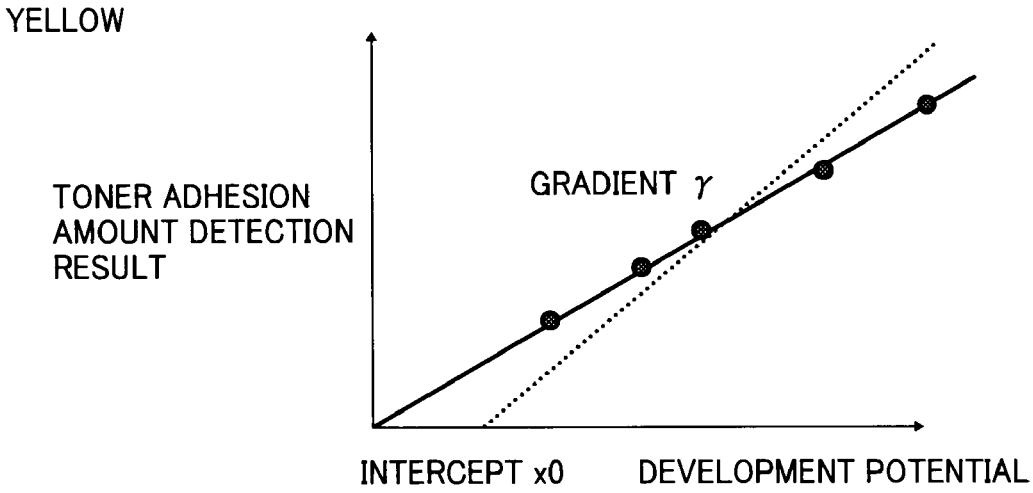
FIGS. 12A to 12D are diagrams illustrating straight lines representing the relationships between the development potentials and the toner adhesion amounts of respective colors when there is the sign of failure in the image forming unit for the Bk color.
Figure 12B:
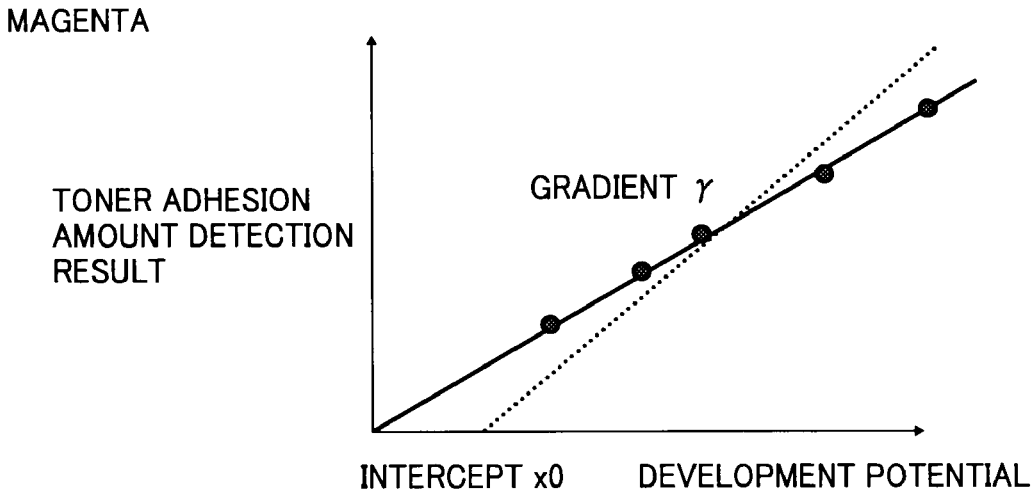
Figure 12C:
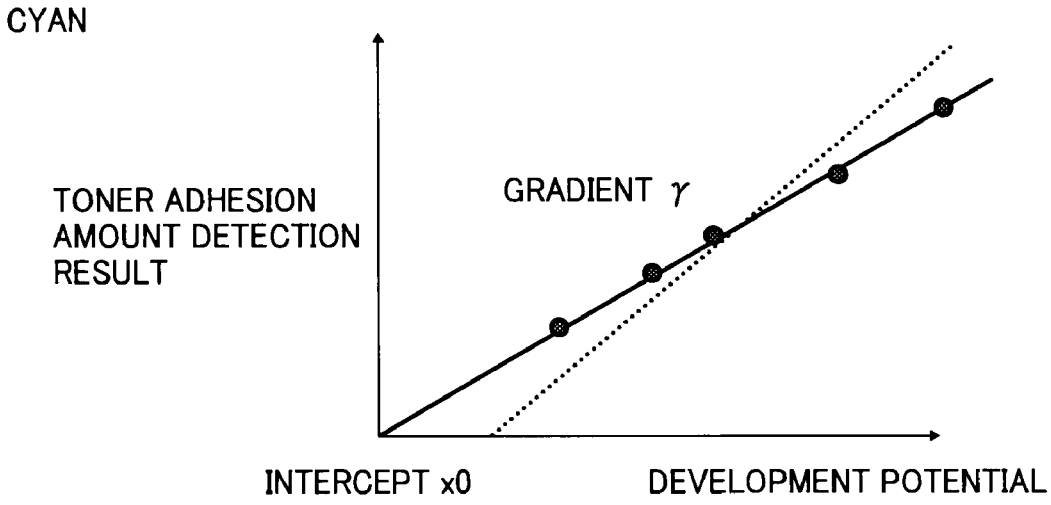
Figure 12D:
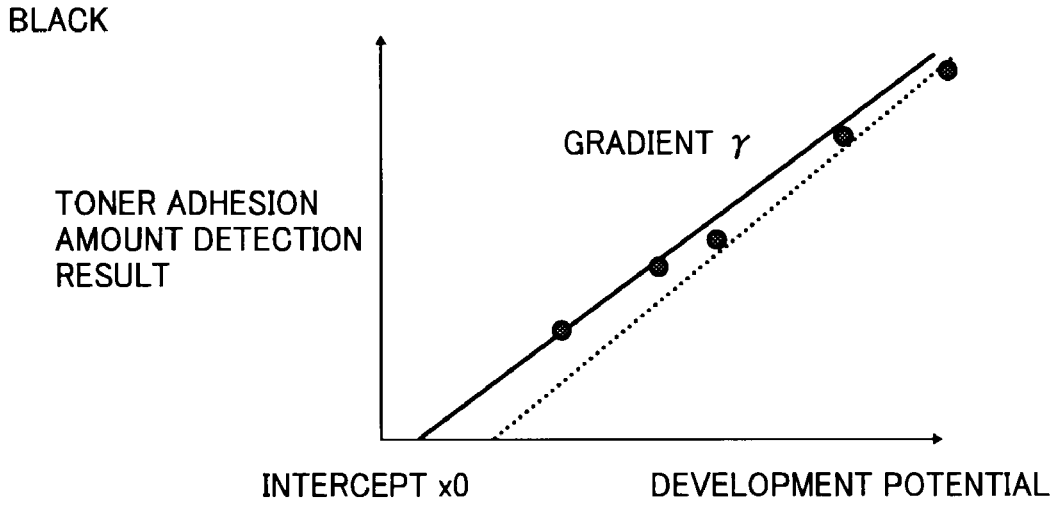
Figure 15D:
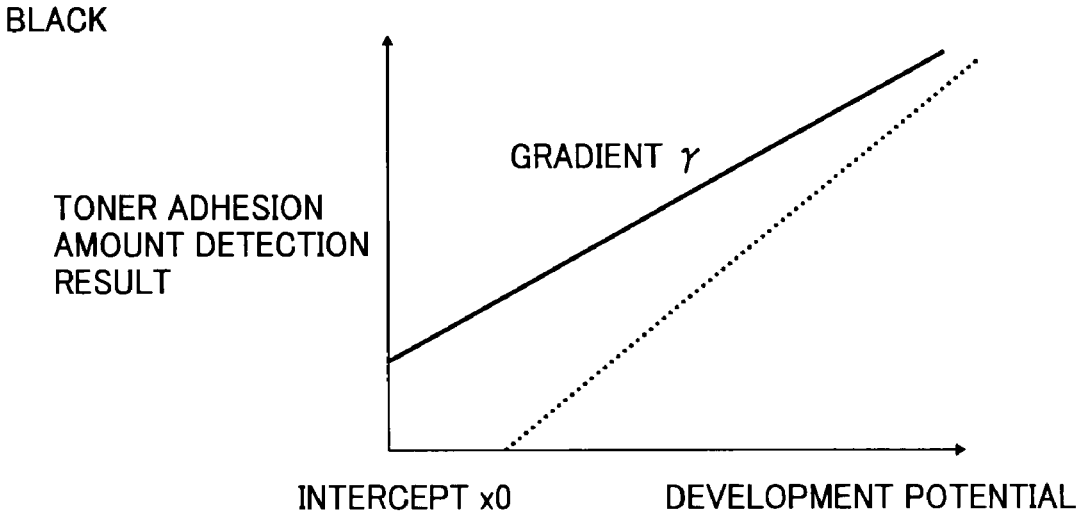

In the above-described example, the optical sensors 51 and 52 are configured to have a different output value only for the Bk color. Alternatively, the optical sensors 51 and 52 may be configured to have different output values for the Y, M, C, and Bk colors. For example, if the output values of the optical sensors 51 and 52 for the Y, M, C, and Bk colors are set to establish the relationship Y>M>C>Bk, and if the image forming unit 30Y for the Y color has the sign of failure, the adhesion amount detection result is substantially higher than the target characteristic in the low-density portion, as in the straight line of FIG. 15D representing the relationship between the development potential and the toner adhesion amount of the Bk color. Further, the increment is increased in the order of the M, C, and Bk colors. As a result, the intercept x0 substantially decreases in all of the M, C, and Bk colors. If the image forming unit 30M for the M color has the sign of failure, the adhesion amount detection result is slightly higher than the target characteristic in the low-density portion and lower than the target characteristic in the high-density portion and a substantial decrease in the intercept x0 occurs in the Y color, as in the straight line of FIG. 12A representing the relationship between the development potential and the toner adhesion amount of the Y color. Meanwhile, in the C and Bk colors, the adhesion amount detection result is substantially higher than the target characteristic in the low-density portion and the substantial decrease in the intercept x0 occurs, similarly as in the straight line of FIG. 15D representing the relationship between the development potential and the toner adhesion amount of the Bk color. If the image forming unit 30C for the C color has the sign of failure, the adhesion amount detection result is slightly higher than the target characteristic in the low-density portion and lower than the target characteristic in the high-density portion and the substantial decrease in the intercept x0 occurs both in the Y and M colors. In the Bk color, the adhesion amount detection result is substantially higher than the target characteristic in the low-density portion and the substantial decrease in the intercept x0 occurs, similarly as in the straight line of FIG. 15D representing the relationship between the development potential and the toner adhesion amount of the Bk color. If the image forming unit 30Bk for the Bk color has the sign of failure, the adhesion amount detection result is slightly higher than the target characteristic in the low-density portion and lower than the target characteristic in the high-density portion and the substantial decrease in the intercept x0 occurs in the Y, M, and C colors, similarly as in FIGS. 12A to 12C.

With the optical sensors 51 and 52 thus configured to have different output values for the colors Y, M, C, and Bk colors, the intercept x0 of each of the colors substantially decreases when the sign of failure occurs in the image forming unit 30 of any color. Accordingly, the failure occurring in the image forming units 30 of the respective colors can be accurately detected.

As the method of differentiating the output value of the optical sensors 51 and 52 among the Y, M, C, and Bk colors, it is conceivable to use optical sensors of different output values for the respective colors, e.g., to use optical sensors which detect light of the visible light range. Alternatively, the toner component may be differentiated among the respective colors so that the respective colors have different optical output values.

Preferably, the image forming units 30 are arranged in descending order of the output value of the optical sensors 51 and 52 from the upstream side in the moving direction of the intermediate transfer belt 21. That is, if the output values of the optical sensors 51 and 52 for the Y, M, C, and Bk colors are set such that the relationship Y>M>C>Bk is established, the image forming units 30Y, 30M, 30C, and 30Bk are arranged in this order from the upstream side in the moving direction of the intermediate transfer belt 21. With this arrangement, toner of a relatively low output value of the optical sensors 51 and 52 adheres onto toner of a relatively high output value of the optical sensors 51 and 52. Accordingly, in an image forming unit 30 located upstream in the moving direction of the intermediate transfer belt 21 of the image forming unit 30 subjected to the failure prediction, it is possible to obtain the straight line representing the relationship between the development potential and the toner adhesion amount which is slightly higher than the target characteristic in the low-density portion and lower than the target characteristic in the high-density portion and which has the intercept x0 substantially lower than the intercept x0 of the target characteristic.

Figure 16:
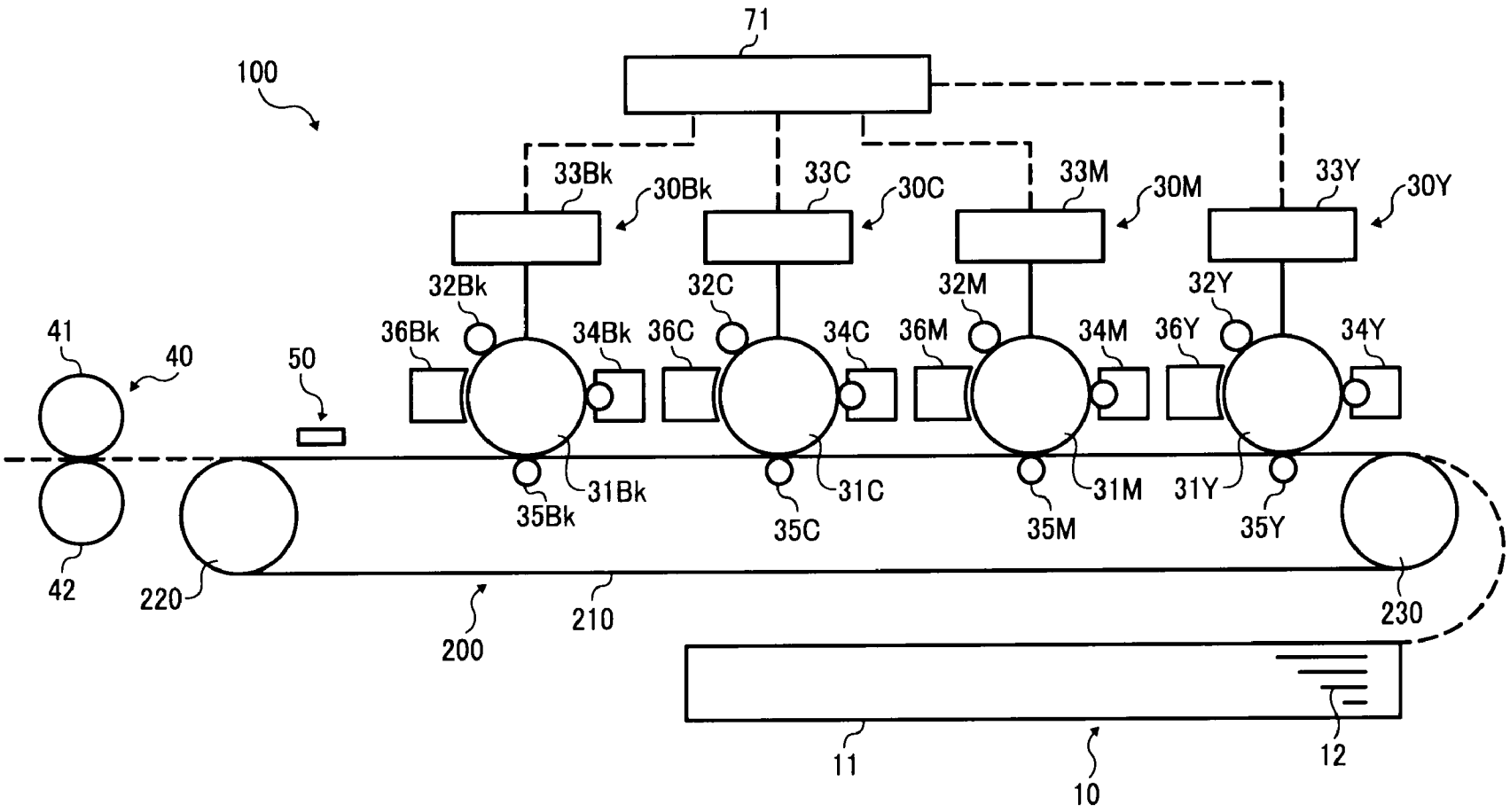
FIG. 16 is a schematic configuration diagram illustrating another example of the image forming apparatus according to the present embodiment.

In the above-described example, the present invention is applied to the tandem-type image forming apparatus according to the intermediate transfer method. The present invention can also be applied to a tandem-type image forming apparatus 100 according to a direct transfer method, as illustrated in FIG. 16. In the image forming apparatus 100 according to the direct transfer method as illustrated in FIG. 16, the adhesion amount detection unit 50 is provided at a position facing a conveyance belt 200. In the process adjustment operation, pattern images of the respective colors are formed on the conveyance belt 200, and the adhesion amounts of the pattern images of the respective colors formed on the conveyance belt 200 are detected by the adhesion amount detection unit 50. Then, on the basis of the adhesion amount detection results of the pattern images on the conveyance belt 200, such parameters as the development bias correction parameter Q and the exposure amount correction parameter P are calculated. That is, in the tandem-type image forming apparatus 100 according to the direct transfer method, the conveyance belt 200 has a function of conveying the recording sheets (transfer sheets) 12 and also a function of an image carrying member for carrying thereon toner images of the respective colors.

To perform the failure prediction in an image forming unit 30, the state index value C is calculated in a similar manner as described above with the use of such parameters as the development bias correction parameter Q calculated on the basis of the pattern images of the respective colors formed on the conveyance belt 200, and then the failure prediction is performed on the basis of the state index value C.

Figure 17:
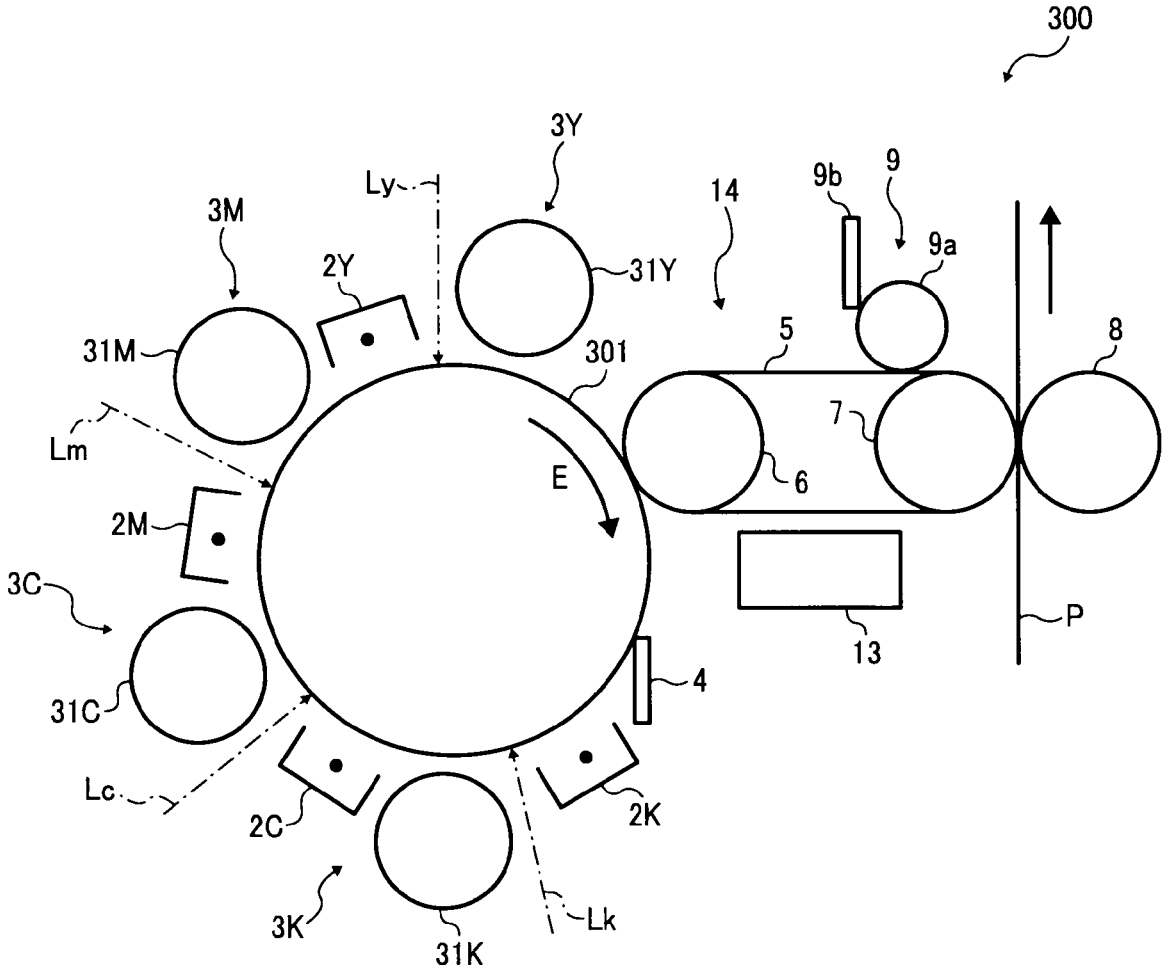
FIG. 17 is a schematic configuration diagram illustrating still another example of the image forming apparatus according to the present embodiment.

Further, as illustrated in FIG. 17, the present invention can also be applied to an image forming apparatus 300 according to a so-called multiple development method, in which development units 3Y, 3M, 3C, and 3K, charging units 2Y, 2M, 2C, and 2K, and exposure units (not illustrated) for the Y, M, C, and Bk colors are disposed around a single photoconductor 301.

As described above, the image forming apparatus according to the present embodiment predicts the failure in an image forming unit from the information based on the adhesion amount detection results obtained through the detection by the optical sensors (i.e., the adhesion amount detection device) of the toner images formed on the intermediate transfer belt (i.e., the image carrying member) by the image forming units (i.e., the toner image forming devices) other than the image forming unit subjected to the failure prediction. If an image forming unit has the sign of failure, a substantial change occurs in the adhesion amount detection results obtained through the detection by the optical sensors of the toner images formed on the intermediate transfer belt by the other image forming units. Thus, the information indicating the sign of failure is included in the adhesion amount detection results of the toner images formed by the image forming units other than the image forming unit having the sign of failure. Accordingly, whether or not the image forming unit subjected to the failure prediction has the sign of failure can be examined on the basis of the information based on the adhesion amount detection results obtained through the detection by the optical sensors (i.e., the adhesion amount detection device) of the toner images formed on the intermediate transfer belt (i.e., the image carrying member) by the image forming units (i.e., the toner image forming devices) other than the image forming unit subjected to the failure prediction.

Further, the chronological data obtained from the chronological adhesion amount detection results includes the information representing the change in the adhesion amount detection results. Thus, whether or not there is a substantial change in the adhesion amount detection results can be detected from the chronological data. Therefore, if the failure prediction of an image forming unit is performed with the use of the chronological data obtained from the chronological adhesion amount detection results, the failure prediction can be performed with less noise and with higher accuracy than the failure prediction of an image forming unit performed on the basis of the adhesion amount detection results.

The toner of the image forming unit having the sign of failure adheres to the toner images formed on the intermediate transfer belt by the image forming units other than the image forming unit having the sign of failure. Thus, the adhesion amounts in the toner images increase. The change in the adhesion amount detection results caused by the image forming unit having the sign of failure similarly occurs irrespective of an increase or a decrease in density of the toner images. For example, if the failure prediction of an image forming unit is performed solely on the basis of the change in the adhesion amount detection result of a toner image of a relatively low density, it is difficult to determine whether the change in the adhesion amount detection results indicates the sign of failure of the image forming unit or a failure of an optical sensor and a resultant change in sensitivity of the sensor in detecting a relatively low adhesion amount. According to the present embodiment, however, the sign of failure of an image forming unit is determined on the basis of the information based on the adhesion amount detection results obtained through the detection by the optical sensors of the pattern images including a plurality of toner images of different densities. Therefore, it is possible to examine whether or not a similar change occurs in the adhesion amount detection results of the plurality of toner images of different densities. Thus, if a similar change occurs in the adhesion amount detection results of the toner images, the change can be determined to indicate the sign of failure of the image forming unit. Meanwhile, if the change occurs only in the adhesion amount detection result of the toner image of the relatively low density, for example, the change can be determined to indicate another cause. Accordingly, the accuracy of the failure prediction of the image forming unit can be improved.

Further, the image forming unit which forms a toner image causing the lowest adhesion amount detection sensitivity in the detection by the optical sensors is disposed downstream of the other image forming units in the moving direction of the intermediate transfer belt. Thus, if the sign of failure occurs in the image forming unit located at the most downstream position in the moving direction of the intermediate transfer belt, the adhesion amount detection results of the toner images of a relatively high density formed by the other image forming units are lower than the normal value, and the adhesion amount detection results of the toner images of a relatively low density formed by the other image forming units are higher than the normal value. Therefore, the development bias correction parameter Q, which is the information based on the adhesion amount detection results obtained through the detection by the optical sensors of the pattern images including the plurality of toner images of different densities, can be substantially changed. Accordingly, the prediction and the determination of failure can be performed with higher accuracy. In particular, as in the present embodiment, if the adhesion amount detection sensitivity is relatively low in the optical sensor for the Bk color, which is more frequently used and shorter in life than the optical sensors for the other colors, and if the image forming unit for the Bk color is disposed at the most downstream position in the moving direction of the intermediate transfer belt, the failure determination of the image forming unit for the Bk color can be accurately performed.

Further, the optical sensors for detecting at least one of near-infrared light and infrared light reflected by the toner images are employed as the optical sensors of the present embodiment. Furthermore, carbon is contained only in the toner of the image forming unit disposed at the most downstream position in the moving direction of the intermediate transfer belt. Since carbon absorbs infrared light, the adhesion amount detection sensitivity of the optical sensors which detect infrared light is reduced in the carbon-containing toner. Therefore, with carbon contained only in the toner of the image forming unit disposed at the most downstream position in the moving direction of the intermediate transfer belt, the image forming unit can constitute the image forming unit which forms the toner image causing the lowest adhesion amount detection sensitivity in the detection by the optical sensors.

Further, the use of the optical sensors which detect at least one of near-infrared light and infrared light eliminates differences in detection sensitivity among the colors. Thus, the adhesion amount detection sensitivities of the toners not containing carbon can be set to the same level. Accordingly, there is no need to prepare the adhesion amount calculation algorithm for each of the toners not containing carbon, and thus a common adhesion amount calculation algorithm can be used for the toners.

Further, the state index value C is calculated from the information based on a plurality of adhesion amount detection results and other information, and the sign of failure of an image forming unit is determined on the basis of the state index value C. Thus, if an information set temporarily indicates abnormality, but if the other information sets indicate normality, the state index value C does not substantially change. As a result, false determination that the image forming unit has the sign of failure is prevented. Accordingly, the failure determination can be performed with higher accuracy than the failure determination performed on the basis of a single information set.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape, are not limited the embodiments and thus may be preferably set. It is therefore to be understood that within the scope of the appended claims, the disclosure of this patent specification may be practiced otherwise than as specifically described herein.

What is claimed is:

1. An image forming apparatus, comprising:

a plurality of toner image forming devices for forming toner images of a plurality of mutually different colors;

a toner image carrying member for carrying on a surface thereof the toner images of the plurality of colors to be transferred onto a recording medium at one time;

an adhesion amount detection device for detecting a toner adhesion amount of each of the toner images of the plurality of colors formed and carried on the surface of the toner image carrying member, the adhesion amount detection device being located at one end of the toner image carrying member; and a failure detection device for detecting signs of failure in the toner image forming devices, wherein the failure detection device detects signs of failure in one of the toner image forming devices on the basis of information based on adhesion amount detection results obtained through detection by the adhesion amount detection device of toner adhesion amounts of toner images formed on the surface of the toner image carrying member by other toner image forming devices.

2. The image forming apparatus as described in claim 1, wherein each of the toner image forming devices includes:

a latent image carrying member for carrying on a surface thereof a latent image, a development device for developing the latent image carried on the surface of the latent image carrying member into a toner image, and a cleaning blade configured to contact the surface of the latent image carrying member and remove transfer residual toner remaining on the surface of the latent image carrying member after transfer of the toner image from the surface of the latent image carrying member to the surface of the toner image carrying member.

3. The image forming apparatus as described in claim 1, wherein the failure detection device detects signs of failure in the toner image forming device on the basis of chronological data obtained from information based on the adhesion amount detection results in chronological order.

4. The image forming apparatus as described in claim 1, wherein the failure detection device detects signs of failure in the toner image forming device on the basis of information based on adhesion amount detection results obtained through detection by the adhesion amount detection device of pattern images including a plurality of toner images of different densities.

5. The image forming apparatus as described in claim 4, wherein one of the toner image forming devices which forms a toner image causing the lowest adhesion amount detection reading during detection by the adhesion amount detection device is disposed downstream of the other toner image forming devices in a direction of movement of the toner image carrying member.

6. The image forming apparatus as described in claim 5, wherein the adhesion amount detection device includes an optical detection device for detecting at least one of near-infrared light and infrared light reflected by the toner images on the toner image carrying member, and wherein carbon is contained only in the toner of the toner image forming device disposed downstream of the other toner image forming devices in the direction of movement of the toner image carrying member.

7. The image forming apparatus as described in claim 1, wherein, on the basis of an index value calculated from the adhesion amount detection results and multiple sets of operation control information, the failure detection device detects signs of failure in the toner image forming device.

8. An image forming apparatus, comprising:

toner image forming means for forming toner images of a plurality of mutually different colors;

toner image carrying means for carrying on a surface thereof the toner images of the plurality of colors to be transferred onto a recording medium at one time;

adhesion amount detection means for detecting a toner adhesion amount of each of the toner images of the plurality of colors formed and carried on the surface of the toner image carrying means, the adhesion amount detection means being located at one end of the toner image carrying means; and failure detection means for detecting signs of failure in the toner image forming means, wherein the failure detection means detects signs of failure in a part of the toner image forming means on the basis of information based on adhesion amount detection results obtained through detection by the adhesion amount detection means of toner adhesion amounts of toner images formed on the surface of the toner image carrying means by other parts of the toner image forming means.

9. A failure detection method of detecting a failure in an image forming apparatus, comprising the steps of:

causing a plurality of toner image forming devices to form, on a surface of a toner image carrying member, toner images of a plurality of mutually different colors to be transferred onto a recording medium at one time;

detecting, using an adhesion amount detection device, a toner adhesion amount of each of the toner images of the plurality of colors formed and carried on the surface of the toner image carrying member, the adhesion amount detection device being located at one end of the toner image carrying member; and detecting signs of failure in the toner image forming devices, wherein in the detecting step signs of failure in one of the toner image forming devices are detected on the basis of information based on adhesion amount detection results obtained through detection in the adhesion amount detection step of detecting toner adhesion amounts of toner images formed on the surface of the toner image carrying member by other toner image forming devices.

10. The failure detection method as described in claim 9, wherein each of the toner image forming devices includes:

a latent image carrying member for carrying on a surface thereof a latent image, a development device for developing the latent image carried on the surface of the latent image carrying member into a toner image, and a cleaning blade configured to contact the surface of the latent image carrying member and remove transfer residual toner remaining on the surface of the latent image carrying member after transfer of the toner image from the surface of the latent image carrying member to the surface of the toner image carrying member.

11. The failure detection method as described in claim 9, wherein in the failure detection step signs of failure in the toner image forming device are detected on the basis of chronological data obtained from information based on the adhesion amount detection results in chronological order.

12. The failure detection method as described in claim 9, wherein in the failure detection step signs of failure in the toner image forming device are detected on the basis of information based on adhesion amount detection results obtained through detection in the adhesion amount detection step of detecting pattern images including a plurality of toner images of different densities.

13. The failure detection method as described in claim 12, wherein one of the toner image forming devices that forms a toner image causing the lowest adhesion amount detection reading during detection in the adhesion amount detection step is disposed downstream of the other toner image forming devices in the direction of movement of the toner image carrying member.

14. The failure detection method as described in claim 13, wherein the adhesion amount detection step includes an optical detection step of detecting at least one of near-infrared light and infrared light reflected by the toner images on the toner image carrying member, and wherein carbon is contained only in the toner of the toner image forming device disposed downstream of the other toner image forming devices in the direction of movement of the toner image carrying member.

15. The failure detection method as described in claim 9, wherein in the failure detection step signs of failure in the toner image forming device are detected on the basis of an index value calculated from the adhesion amount detection results and plural sets of operation control information.

* * * * *